US006629624B2

(12) United States Patent
Stillinger et al.

(10) Patent No.: US 6,629,624 B2
(45) Date of Patent: Oct. 7, 2003

(54) DRINK SPOUT SYSTEM

(75) Inventors: Scott H. Stillinger, Monte Sereno, CA (US); Donald J. Panec, South San Francisco, CA (US)

(73) Assignee: Acorn Bay, LLC, Monte Sereno, CA (US)

( * ) Notice: Subject to any disclaimer, the term of this patent is extended or adjusted under 35 U.S.C. 154(b) by 0 days.

(21) Appl. No.: 09/895,059

(22) Filed: Jun. 29, 2001

(65) Prior Publication Data

US 2002/0121525 A1 Sep. 5, 2002

Related U.S. Application Data

(60) Provisional application No. 60/273,781, filed on Mar. 5, 2001.

(51) Int. Cl.[7] ..... A47G 19/22

(52) U.S. Cl. ..... 220/714; 220/717; 220/705; 220/254.7; 220/254.9; 222/525; 222/490

(58) Field of Search ..... 220/714, 717, 220/705, 254.7, 254.9; 222/525, 490, 514

(56) References Cited

U.S. PATENT DOCUMENTS

| | | | |
|---|---|---|---|
| 274,447 | A | 3/1883 | Kennish |
| 1,550,305 | A | 8/1925 | Dreischerf |
| 2,107,442 | A | 2/1938 | Hughes |
| 2,194,011 | A | 3/1940 | Davidson |
| 2,533,305 | A | 12/1950 | Wells |
| 2,676,744 | A | 4/1954 | Baselt |

(List continued on next page.)

FOREIGN PATENT DOCUMENTS

| | | |
|---|---|---|
| DE | 1087968 | 8/1960 |
| DE | 31659 | 9/1964 |
| DE | 1 486 403 | 5/1969 |
| DE | 586787 A1 | 3/1993 |
| DE | 196 40 629 A1 | 4/1998 |
| DE | 196 50 706 A1 | 5/1998 |
| EP | 0385603 B1 | 2/1990 |
| GB | 688531 | 3/1953 |
| GB | 2 028 779 A | 3/1980 |
| GB | 2 109 870 A | 6/1983 |
| GB | 2217677 A | 11/1989 |
| JP | 45-37339 | 11/1970 |
| WO | WO 98/45184 | 10/1998 |
| WO | WO 99/37552 | 7/1999 |
| WO | WO 00/16667 | 3/2000 |
| WO | WO 00/16668 | 3/2000 |

OTHER PUBLICATIONS

Fig. 5 of what is believed to be a British patent from 1909.

English language abstract of Soviet Union Patent No. SU925408, 1992.

English language abstract of European Patent No. EP 586787A1, 1994.

*Primary Examiner*—Jes F. Pascua
(74) *Attorney, Agent, or Firm*—Kolisch Hartwell, P.C.

(57) ABSTRACT

Drink spout systems and drink containers that include a drink spout system. In some embodiments, the drink spout system includes an air return system to permit improved dispensing from the drink container. In some embodiments, the drink spout system is actuated by a user sucking on the system. In others, the system is actuated by a user depressing or bending at least a portion of the system. In still others, the system is actuated by other user-imparted forces to the system. In some embodiments, the drink spout system includes a biasing system adapted to preload the system's valve assembly to a closed configuration. In some embodiments, the drink spout system includes components formed from different materials via two-shot molding or a similar process, and in some embodiments, the materials used are selected to provide improved opening of the systems' valve assembly.

89 Claims, 14 Drawing Sheets

U.S. PATENT DOCUMENTS 2,691,466 A 10/1954 Efford et al.
2,773,722 A 12/1956 Abplanalp
2,781,956 A 2/1957 Sherbondy
2,802,608 A 8/1957 Gassaway
2,805,809 A 9/1957 Pugh
2,898,018 A 8/1959 Borah
2,948,453 A 8/1960 Drown
2,977,231 A 3/1961 Fox et al.
3,042,319 A 7/1962 Burd
3,067,787 A 12/1962 Salk
3,093,273 A 6/1963 Borah
3,165,241 A 1/1965 Curry
3,232,499 A 2/1966 Esposito, Jr.
3,268,792 A 8/1966 Barmherzig
3,285,477 A 11/1966 Marona et al.
3,298,577 A 1/1967 Chlystun
3,372,832 A 3/1968 Yeater et al.
3,620,421 A 11/1971 MacGuire-Cooper
3,690,522 A 9/1972 Chlystun
3,819,151 A 6/1974 Kish
3,915,331 A 10/1975 Chenault
4,019,663 A 4/1977 Krautkramer
4,102,476 A 7/1978 Loeffler
4,133,319 A 1/1979 Bloomfield
4,135,513 A 1/1979 Arisland
4,159,790 A 7/1979 Bailey
4,165,825 A 8/1979 Hansen
4,179,052 A 12/1979 Abbott
4,189,072 A 2/1980 Conn
4,245,752 A 1/1981 Prueher
4,417,672 A 11/1983 Eppenbach
4,422,563 A 12/1983 Babiol
4,450,985 A 5/1984 Beard
4,483,465 A 11/1984 Lawrence
4,493,444 A 1/1985 Del Bon et al.
4,513,891 A 4/1985 Hain et al.
4,555,048 A 11/1985 Hamman et al.
4,560,081 A 12/1985 Adams
4,714,173 A 12/1987 Ruiz
4,723,689 A 2/1988 Vallos et al.
4,726,491 A 2/1988 Moon
4,728,006 A 3/1988 Drobish et al.
4,773,572 A * 9/1988 Stull ..... 222/521
4,776,495 A 10/1988 Vignot
4,801,007 A 1/1989 Rule
4,828,141 A 5/1989 Coy
4,848,601 A 7/1989 Reil
4,927,061 A 5/1990 Leigh et al.
4,941,598 A 7/1990 Lambelet, Jr. et al.
4,946,062 A 8/1990 Coy
4,982,881 A * 1/1991 Amrein ..... 222/514
5,004,126 A 4/1991 Klesius
5,039,012 A 8/1991 Inaba
5,052,575 A 10/1991 Ravreby
5,052,614 A 10/1991 Xuan
5,072,842 A 12/1991 White
5,088,614 A 2/1992 Dumestre
5,141,133 A 8/1992 Ninomiya et al.
5,158,633 A 10/1992 Rausing
5,169,026 A 12/1992 Patterson
5,169,035 A 12/1992 Imbery, Jr.
5,238,153 A 8/1993 Castillo et al.
5,240,149 A 8/1993 Schmidt
5,244,113 A 9/1993 Stymiest
5,249,708 A 10/1993 Magness
5,255,813 A 10/1993 Berggren et al.
5,265,777 A * 11/1993 Weinstein ..... 222/517
5,301,858 A 4/1994 Hollander
5,339,982 A 8/1994 Tardie
5,366,114 A 11/1994 Bernstein et al.
5,431,308 A 7/1995 Tchen
5,465,866 A 11/1995 Belcastro
5,472,122 A 12/1995 Appleby
5,615,809 A 4/1997 Feer et al.
5,676,289 A 10/1997 Gross et al.
5,785,301 A 7/1998 Scheindel
5,791,510 A 8/1998 Paczonay
5,823,422 A 10/1998 Collier et al.
5,839,626 A 11/1998 Gross et al.
5,850,908 A 12/1998 Jasek
5,850,930 A 12/1998 Jonsson et al.
5,855,298 A 1/1999 Teetsel, III et al.
5,860,540 A 1/1999 Bock
5,860,586 A 1/1999 Anchor et al.
5,873,478 A 2/1999 Sullivan et al.
5,884,837 A 3/1999 Jacobsson et al.
5,890,620 A 4/1999 Belcastro
5,927,565 A * 7/1999 Paczonay ..... 222/484
5,934,512 A 8/1999 Lampe et al.
5,947,318 A 9/1999 Palm
5,954,237 A 9/1999 Lampe et al.
6,050,444 A 4/2000 Sugg
6,062,435 A 5/2000 Hess, III
6,076,704 A 6/2000 Weiler et al.
6,079,589 A 6/2000 Matsuyama et al.
6,102,245 A 8/2000 Haberman
6,135,311 A 10/2000 Panec et al.
6,213,351 B1 * 4/2001 Stoneberg et al. ..... 222/153.14
6,227,419 B1 * 5/2001 Raboin ..... 222/484
6,269,968 B1 8/2001 Belcastro
6,299,027 B1 * 10/2001 Berge et al. ..... 222/153.14
6,305,570 B1 * 10/2001 Atkin et al. ..... 220/714
6,367,668 B1 4/2002 Schwanenberg

* cited by examiner

Fig. 1
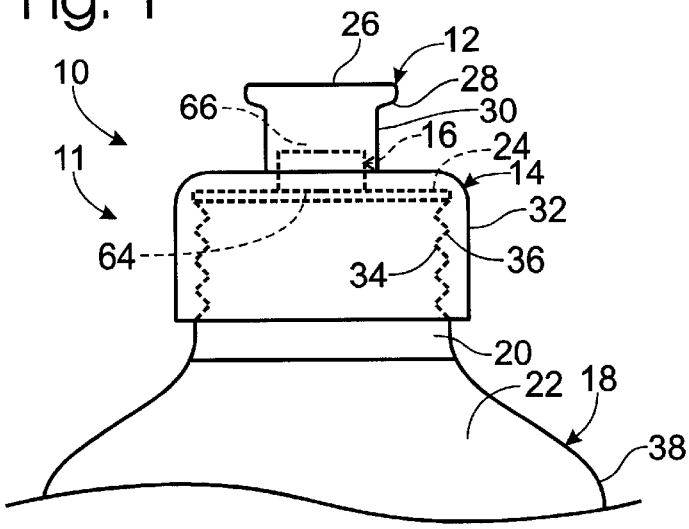
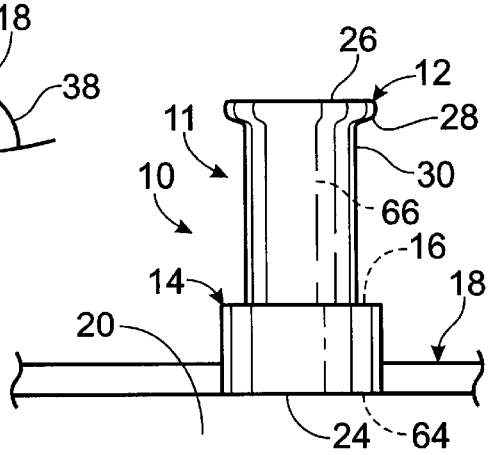
Fig. 2
Fig. 3
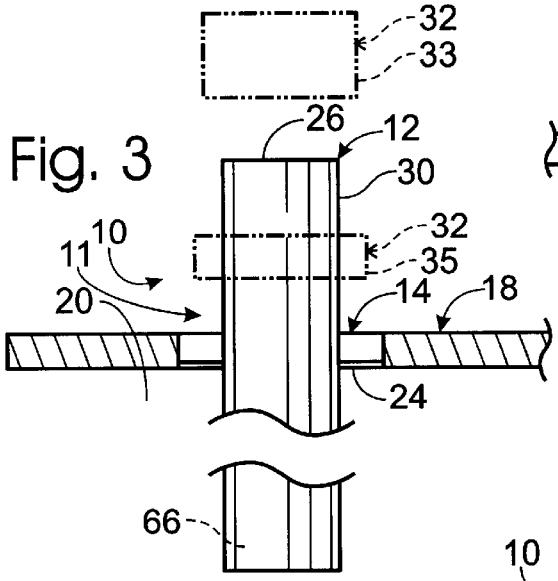
Fig. 4
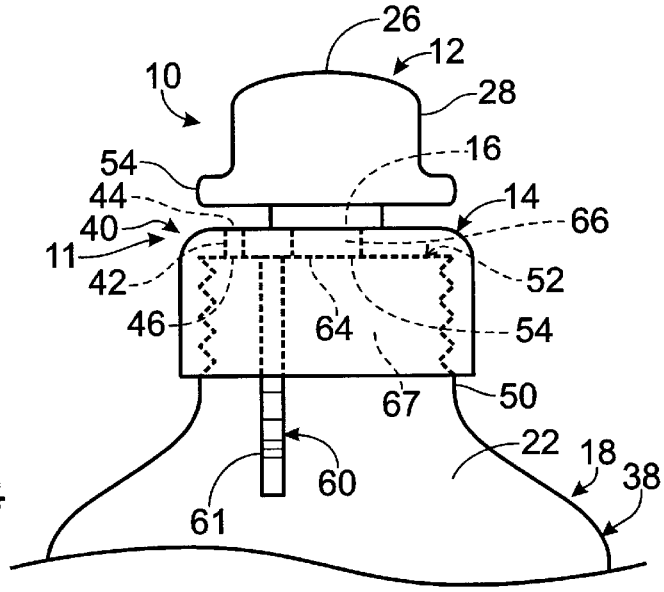

DRINK SPOUT SYSTEM

RELATED APPLICATION

This application claims priority to U.S. Provisional Patent Application Serial No. 60/273,781, which was filed on Mar. 5, 2001, is entitled "Drink Spout System," and the complete disclosure of which is hereby incorporated by reference for all purposes.

FIELD OF THE INVENTION

This invention relates generally to drink spout systems and drink containers that include a drink spout system for selectively dispensing drink fluid from the container.

BACKGROUND OF THE INVENTION

Aseptic drink pouches and boxes have become popular ways to conveniently package and sell drinks. An aseptic drink pouch is a flexible pouch that is typically formed from plastic, or plastic and foil, and which is free or freed from pathogenic microorganisms. An aseptic drink box is a box that is free or freed from pathogenic microorganisms. Aseptic drink boxes are typically formed of cardboard, paper, plastic, foil and combinations thereof. Drink boxes typically include a plastic liner, wax coating or other suitable liner or coating to provide a waterproof enclosure for a drink fluid. An aseptic drink pouch or box typically includes a hole in the top of the pouch or box covered by thin layers of plastic and/or foil. The pouch or box is sold with a straw that is used to pierce the foil and plastic and extend through the hole for drinking. However, drink pouches and boxes have the drawback of allowing liquid to spill. For example, drink pouches and boxes often spill when the straw is inserted because the user is holding the pouch or box in one hand while trying to insert the straw through the foil and plastic into the straw hole. The pressure of holding the pouch or box and pressing the straw against the foil and plastic covering the hole often causes the liquid to spray out of the hole or out of the straw as the foil and plastic are pierced. Drink pouches and boxes also spill when tipped because the straws used to pierce and drink from the pouches or boxes do not include a closable valve for preventing liquid from being dispensed through the straws.

Drinks are also packaged and sold in drink bottles, which are typically formed of plastic or glass. These bottles often include a foil or plastic seal that covers the opening of the bottle and that must be removed before a user can drink out of the bottle. Once removed, the drink may spill if the bottle is tipped. Drink bottles may be refilled for multiple uses, and in some cases, are originally sold without a drink fluid.

SUMMARY OF THE INVENTION

The inventions described herein include various drink spout systems, as well as drink containers that include a drink spout system. In some embodiments, the drink spout system includes an air return system to permit improved dispensing from the drink container. In some embodiments, the drink spout system is actuated by a user sucking on the system. In others, the system is actuated by a user depressing or bending at least a portion of the system. In still others, the system is actuated by other user-imparted forces to the system. In some embodiments, the drink spout system includes a biasing system adapted to preload the system's valve assembly to a closed configuration. In some embodiments, the drink spout system includes components formed from different materials via two-shot molding or a similar molding process, and in some embodiments, the materials used are selected to provide improved opening of the system's valve assembly.

Various views of drink spout systems according to the present invention, and drink containers including the same, are shown in the Figures described below. It should be understood that the Figures speak for themselves regarding the material shown therein, but additionally and/or alternatively are described below.

BRIEF DESCRIPTION OF THE DRAWINGS

FIG. 1 is a schematic side elevation view of a drink spout system according to the present invention and mounted on a drink container.

FIG. 2 is a schematic side elevation view of a drink spout system according to the present invention and mounted on a drink container.

FIG. 3 is a schematic side elevation view of a drink spout system according to the present invention that does not include a valve assembly.

FIG. 4 is a schematic side elevation view of a drink spout system according to the present invention that includes an air return system and a flow restrictor.

DETAILED DESCRIPTION AND BEST MODE OF THE INVENTION

Figure 5:
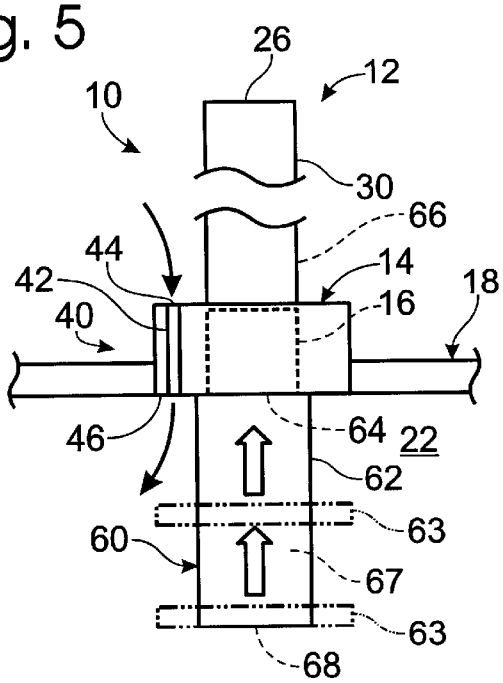
FIG. 5 is a schematic side elevation view of another drink spout system according to the present invention that includes an air return system and a flow restrictor.

A drink spout system according to the present invention is shown in FIG. 1 and generally indicated at 10. Drink spout system 10 includes a body 11. The body includes a dispensing portion 12 and a base portion 14. The drink spout system also includes a valve assembly 16. The dispensing portion, base portion and valve assembly of drink spout system 10, as well as the other drink spout systems illustrated and described herein, are coupled together. By this it is meant that these components are either removably or permanently secured together as a group, but each of these components does not have to be in direct contact with both of the other two components when the drink spout system is assembled and operational. For example, in the illustrative embodiment shown in FIG. 1, valve assembly 16 may be removably or permanently mounted on one of base portion 14 or dispensing portion 12, and not the other one of base portion 14 or dispensing portion 12, yet the valve assembly would still be described as being coupled to the base and dispensing portions.

In FIG. 1, drink spout system 10 is shown mounted on a drink container 18. Drink container 18 defines an internal compartment 20 that is adapted to receive a volume of a drink fluid 22, such as water, juice, sports drinks, fruit-flavored drinks, carbonated beverages, water-based beverages, milk products, health or dietary beverages, and the like. As used herein, the term "drink container" is meant to refer to hand-held containers that contain a drink fluid and which a user may drink directly from. The term includes drink boxes, drink pouches and drink bottles, including aseptic versions of the same. Typically the drink containers contain less than approximately a gallon of drink fluid, and more typically contain approximately a liter or less of drink fluid. The drink containers may be prepackaged or adapted to be filled by a user. Similarly, the drink containers may be disposable single-use containers or they may be adapted to be refilled by a user. Illustrative examples are drink containers that are prepackaged to hold 4, 6, 8, 12, 16 and 20 ounces of drink fluid.

In FIG. 1, drink container 18 takes the form of a drink bottle, and in FIGS. 2 and 3, the drink container takes a generic form to indicate any of the above-described types of drink containers. It should be understood that the drink spout systems described herein may be implemented on any type of drink containers, including drink bottles, pouches and boxes. For purposes of illustration, the Figures forming a part of this application will illustrate various versions of drink containers. However, an embodiment of a drink spout system according to the present invention should not be limited to use only on the particular form of drink container shown in the Figures. Instead, it is within the scope of the invention that the drink spout systems described and illustrated herein may be used on any type of drink container. Accordingly, the base portion of the drink spout systems may vary as the systems are adapted to use on different types of drink containers.

Drink container 18 or drink spout system 10 may, but does not necessarily, include a seal, or piercing region, 24 that is adapted to be pierced to initially dispense the drink fluid from the container or to initially fill the container with drink fluid. An example of a drink container with a piercing region is schematically illustrated in FIG. 2. It should be understood that region 24 may be a specialized region on the drink container, such as a region of decreased thickness or a region that requires less force to pierce. However, region 24 may also be the particular user-selected region on the drink container that is pierced by a portion of the drink spout system. Drink boxes and drink bottles generally have defined piercing regions, while drink pouches typically have either defined piercing regions or piercing regions selected by the user.

Dispensing portion 12 includes any suitable structure for dispensing drink fluid 22 from the drink container for drinking, such as to a user's mouth. Dispensing portion 12 includes an outlet 26, through which drink fluid 22 exits drink container 18 through drink spout system 10. Outlet 26 may form part of a mouthpiece 28 that is adapted to be received into a user's mouth. The dispensing portion may additionally or alternatively include at least a portion of a straw structure 30 interconnecting the valve assembly 16 and outlet 26. Illustrative examples of dispensing portions are shown in FIGS. 1–3. In FIG. 1, dispensing portion 12 includes a mouthpiece 28 and a relatively short straw structure 30. In FIG. 2, dispending portion 12 includes a mouthpiece and an elongate straw structure 30. In FIG. 3, dispensing portion 12 includes a straw structure without a mouthpiece.

Base portion 14 includes any suitable structure adapted to couple the drink spout system to the drink container. Typically, the base portion provides a mount or support for the dispensing portion and/or the valve assembly. Base portion 14 may be releasably mounted on the drink container, permanently mounted on the drink container, or base portion 14 may include both releasably and permanently mounted portions. By "releasably mounted" it is meant that the corresponding portion is designed to be removed and replaced relative to the drink container. For example, a threaded cap is releasably mounted on a corresponding set of threads on a drink bottle, such as schematically illustrated in FIG. 1 with base portion 14 including a cap 32 with threads 34 that threadingly engage corresponding threads 36 on drink bottle 38. By "permanently mounted" it is meant that the corresponding portion is designed not to be removed from the drink container without destroying or impairing the intended operability of at least one of the drink container and the drink spout system. For example, a base portion that is integrally formed with or adhered or otherwise bonded to a drink container is permanently mounted on the drink container, such as schematically illustrated in FIG. 2. An example of a base portion 14 that includes both permanently and releasably mounted portions includes a first portion that is permanently mounted on the drink container, and a second portion that is releasably mounted on the first container, thereby also releasably mounting the second portion on the drink container.

It is also within the scope of the invention that dispensing portion 12 and/or valve assembly 16 are releasably or permanently mounted on base portion 14. For example, in the embodiments shown in FIGS. 2 and 3, dispensing portion 12 may be permanently mounted on base portion 14, such as by being integrally formed with the base portion, or it may be joined to the base portion during assembly of the drink valve system. In the illustrative embodiments shown in FIGS. 2 and 3, the dispensing portion may alternatively be releasably mounted on the base portion, thereby enabling the dispensing portion to be repeatedly removed and replaced relative to the base portion.

Valve assembly 16 includes any suitable structure that is selectively configurable between a dispensing position, or orientation, in which drink fluid may be dispensed from the drink container through the dispensing portion, and a closed position, or orientation, in which drink fluid cannot be dispensed from the drink container through the dispensing portion. Valve assembly 16 may be described as defining a gate structure that selectively permits drink fluid to flow therethrough, depending upon the position or orientation of the valve assembly. Still another way to describe valve assembly 16 is that it defines an inlet 64 to a dispensing fluid conduit 66 through which drink fluid from container 18 may flow to outlet 26, as shown in dashed lines in FIGS. 1–2. When the valve assembly is in its dispensing position, the inlet is open and drink fluid may flow therethrough. When the valve assembly is in its closed position, the inlet is closed, or obstructed, and drink fluid cannot flow therethrough. The length of fluid conduit 66 may vary, such as a very short fluid conduit that is formed when valve assembly 16 is located proximate the outlet of the dispensing portion, such as with a push-pull valve, and a longer fluid conduit that is formed when valve assembly 16 is located further away from outlet 26.

Valve assembly 16 may require user manipulation to configure the valve assembly from its closed configuration to its dispensing configuration and/or to return the valve assembly from its dispensing orientation to its closed orientation. For example, valve assembly 16 may be a push-pull valve, such as is used on many conventional water and sports drink bottles, and which requires user manipulation to open and close the valve assembly.

Alternatively, the valve assembly may be self-sealing, in that it is biased to return automatically to the closed orientation upon release of user-imparted forces deforming the valve assembly to its dispensing orientation. A benefit of a self-sealing valve assembly 16 is that the valve assembly will reduce or prevent spills because the valve assembly automatically returns to its closed position upon removal of any user-imparted, or user-applied, forces that urged the valve assembly to its dispensing position. Another benefit of a self-sealing valve assembly is that it takes less time and effort to use, because the user does not have to exert the effort, or even remember, to return the valve assembly to its closed position after every use.

Another example of a self-sealing valve assembly 16 according to the present invention is a pressure-differential valve assembly that is actuated by a pressure differential on opposing sides of the valve assembly, such as when the user sucks on the dispensing portion or when the drink container is squeezed or otherwise collapsed by a user. A self-sealing valve assembly may, but does not necessarily, require user manipulation of the valve assembly to configure the valve assembly to its dispensing configuration. As used herein, "user manipulation" is meant to refer to reconfiguration of the valve assembly caused by a user exerting force upon the valve assembly other than by sucking on the dispensing portion or squeezing or collapsing the drink container. Examples of user manipulation include pulling, pushing, tilting or rotating a portion of the drink spout system, such as the dispensing portion.

It is also within the scope of the present invention that the drink spout system may be formed without a valve assembly. As such, drink fluid may pass through the dispensing portion at all times after the seal, if any, of a drink container has been pierced by the drink spout system. An example of such a drink spout system is schematically illustrated in FIG. 3. In such an embodiment, a cap, clamp or other closure mechanism 32 may be used to prevent drink fluid from being dispensed through the drink spout system. For example, a cap may be releasably mounted on the end of straw structure 30, such as shown in dashed lines in FIG. 3 and indicated at 33. As another example, the drink spout system may include a clamp that temporarily closes the fluid passage within straw structure 30, such as by crimping or compressing the sides of the straw structure together. For purposes of illustration, an example of such a clamp is illustrated schematically in dashed lines a 35 in FIG. 3. In a drink spout system without a valve assembly 16, the dispensing and/or base portions of the drink spout system will define the inlet of the dispensing fluid conduit, which drink fluid may at all times flow through, absent the use of a closure mechanism 32.

Examples of further embodiments and components of drink spout systems and drink containers are shown and described in co-pending U.S. patent application Ser. No. 09/639,648, which was filed on Aug. 16, 2000, is entitled "Drink Valve," and the complete disclosure of which is hereby incorporated by reference. Others are described in co-pending U.S. patent application Ser. No. 09/710,189, which was filed on Nov. 10, 2000, is entitled "Retractable Drink Spout," and the complete disclosure of which is hereby incorporated by reference. Still others are disclosed in U.S. patent application Ser. No. 09/754,953, which was filed on Jan. 3, 2001, is entitled "Piercing Drink Spout System," and the complete disclosure of which is hereby incorporated by reference.

It is within the scope of the invention that the following features and spout systems maybe used as shown, or with any of the drink spout systems described above and incorporated by reference herein. For purposes of illustration, many of the subsequently discussed drawings may include multiple features implemented together on a drink spout system. It should be understood, however, that features described and/or illustrated herein may be implemented alone or in combination with one or more other features and drink spout systems described herein.

In FIG. 4, a drink spout system is shown that includes an air return system 40. Air return system 40 is adapted to enable air from external the drink container to return to the drink container's compartment 20 as drink fluid is being dispensed from the drink container. This improves the flow rate of fluid by reducing the pressure differential required to dispense drink fluid from the drink container. Air return system 40 also enables drink fluid to be continuously drawn from the drink container because the air return system releases the pressure differential that otherwise would accumulate as drink fluid is drawn from a drink container without an air return system.

By comparison, consider a conventional drink container, such as a drink bottle, a drink box, or another drink container other than a collapsible drink pouch. In such a drink container, the amount of pressure that must be applied to dispense drink fluid increases as a function of how much fluid has been dispensed during a drinking interval. When a user ceases to draw fluid from the drink container, the drink container then relieves the accumulated pressure differential by drawing air into the drink container through the valve assembly. For example, the gurgling or sucking noises produced by conventional drink bottles exemplify this event. Typically, a user is forced to interrupt the flow of drink fluid from the drink container so that the drink container can release the accumulated pressure. In other words, the accumulated pressure differential often reaches a level that substantially or completely stops the flow of drink fluid from the conventional drink spout system. When this occurs, the accumulated pressure is at least substantially as great as the suction or other user-applied force urging drink fluid from the drink container.

In experiments, a drink spout system with an air return system according to the present invention enables drink fluid to be dispensed more quickly than a corresponding drink spout system without an air return system according to the present invention. For example, a drink spout system with an air return system according to the present invention may dispense drink fluid in the range of approximately 25% and approximately 100% (or more) of the rate at which a comparable drink spout system without an air return system dispenses drink fluid under similar conditions. In some embodiments, the drink spout system may dispense fluid in the range of approximately 50% and approximately 90% of a comparable system without an air return system, in still others, the drink fluid may be dispensed in the range of approximately 90% and 110% of the comparable rate of a drink spout system without an air return system according to the present invention, and in still others the drink fluid may be dispensed at a rate that is more than 100% greater than the comparable rate of a drink spout system without an air return system according to the present invention.

Air return system 40 includes at least one air return passage 42 with an air return inlet 44 external the drink container and an air return outlet 46 internal the drink container. It is within the scope of the present invention that the air return system may include two or more passages, such as several passages radially spaced around the base portion, such as around the perimeter region of the base portion. Preferably, the size and number of air return passages 42 used in air return system 40 are selected to be sufficient to offset the pressure differential established as drink fluid is dispensed from the drink container. Generally, the number of passages may vary, with more passages typically being used as the cross-sectional dimension of the passages decreases and a fewer number of passages being used as the cross-sectional dimension of the passage or passages increases.

Air return system 40 is typically used on drink containers such as drink bottles and drink boxes that do not substantially collapse as drink fluid is removed therefrom. Because drink pouches typically collapse as drink fluid is withdrawn therefrom, the flow of drink fluid from these drink containers is not impaired by a pressure differential that builds up as the user drinks from the corresponding drink spout assembly. Instead, the drink pouch collapses inwardly. However, drink pouches constructed according to the present invention may include an air return system, such as when the pouch has sufficient resiliency to resist being collapsed inward as drink fluid is removed from the drink container.

Air return system 40 may be positioned in any suitable location on drink container 18, including positions in which the air return system is separately formed from the dispensing portion, base portion and valve assembly of the drink spout system. For example, drink container 18 may include an air return system, with or without a return valve assembly 70 at one location on the container, and a drink spout system 10 at another location on the container spaced-apart from the first location.

In some embodiments, the air return system is integrated with the other components of the drink spout system so that the air return system may be mounted on the drink container with the rest of the drink spout system. In such an embodiment, the air return and drink spout systems may utilize a common fluid conduit formed in the drink container. When the air return system is integrated with the rest of the drink spout system, it may produce a composite, or integrated, drink spout system that has less components and/or requires less assembly than a comparable system having separate air return and drink spout systems. Similarly, an integrated system may utilize a common fluid conduit formed in the drink container, whereas separately formed components may require separate fluid conduits, or passages, in the container, which in turn may increase the manufacturing cost of the container.

For example, when drink container 18 is a drink bottle, it may be desirable for air return system 40 to be integrated with the rest of the drink spout system, or at least the base portion of the drink spout system, so that it may be mounted on the drink container with the rest of the system. More specifically, drink bottles tend to have rather narrow necks 50 with openings 52 having diameters less than six centimeters, and in some embodiments having openings with diameters that are less than 4 or 5 centimeters or in the range of 3 and 4 or 3 and 5 centimeters. Illustrative examples of suitable diameters for opening 52 include diameters that are (or are approximately) 2.6 centimeters, 2.8 centimeters, 3.05 centimeters, 3.8 centimeters and 4.3 centimeters. This sizing does not readily enable the air return system to be separately formed and mounted on the drink container unless the drink container includes a separate fluid conduit through which air return system 40 may selectively return air to the container. Although this is within the scope of the invention, it requires that the drink container have more than one opening, and/or that the air return system be mounted on the drink container in a separate manufacturing or assembly step. Similarly, because many drink bottles, such as glass bottles and hot-filled bottles are not collapsable, the pressure differential accumulates in these drink containers faster than in partially or completely collapsable drink containers, such as plastic drink bottles and drink boxes. Similarly, a user cannot apply at least a portion of the user-applied forces by squeezing the drink bottle to at least partially collapse the drink bottle and thereby urge drink fluid to be dispensed through the drink spout system.

When the drink spout system and air return system are integrated together, such as with the air return system extending generally radially outward relative to the fluid conduit of the valve assembly, it is preferable for inlet 44 of the air return system to be located in a position where the user's mouth will not obstruct the inlet when the user drinks from the dispensing portion. Otherwise, the benefit of having an air return system may be impaired or lost if the user's mouth occludes the inlets of the air return system. For example, this may be accomplished by locating the mouthpiece sufficiently far away from inlet 44 so that a user's mouth does not block the inlets of the air return system when the user drinks from dispensing portion 12. An example of another suitable configuration for air return system 40 is for the system to include a cover portion 54 on dispensing portion 12 or base portion 14 that prevents a user's lips from covering the inlet. Still another example is for the inlet or inlets of the air return system to be positioned on the drink spout system so that it/they will not be obstructed by a user's mouth if the user drinks directly from the mouthpiece, straw structure or other form of dispensing region adapted to have a user drink directly therefrom.

Figure 6:
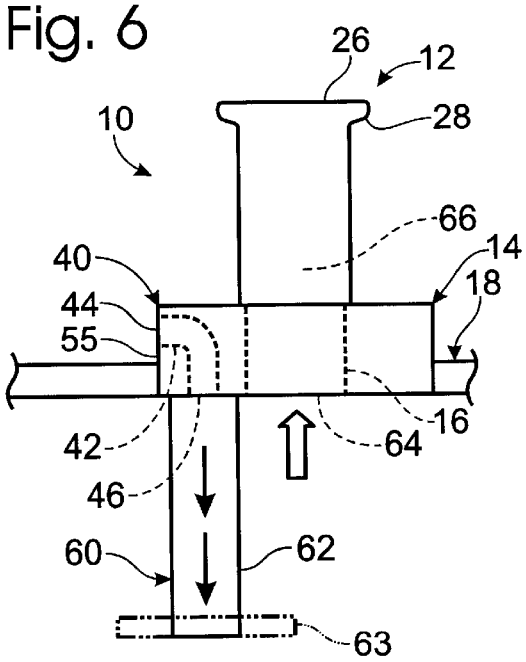
FIG. 6 is a schematic side elevation view of another drink spout system according to the present invention that includes an air return system and a flow restrictor.

Examples of the above constructions are schematically illustrated in FIGS. 4–6, with FIG. 4 showing a drink container in the form of a bottle, and FIGS. 5 and 6 demonstrating generically any suitable drink container. As discussed, the particular type of drink container shown in the Figures should be construed in an illustrative, rather than a limiting, sense. In FIG. 4, dispensing portion 12 includes a flange distal outlet 26 that forms cover portion 54 and thereby prevents a user's lips from covering inlet 44 when a user drinks from the drink spout system. In FIG. 5, base portion 14 includes air return system 40 and dispensing portion 12 includes a straw structure 30 of sufficient length that a user's lips do not, or typically do not, reach inlet 44 when a user drinks from straw structure 30. In FIG. 6, base portion 14 includes air return system 40 with an inlet 44 oriented generally transverse to outlet 26. Another way of describing the embodiment illustrated in FIG. 6 is that the base portion includes a sidewall 55 and the air return system includes an inlet 44 in sidewall 55.

Figure 7:
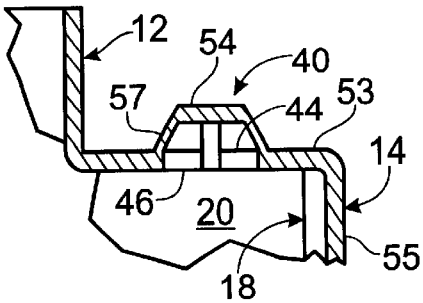
FIG. 7 is a fragmentary, partial cross-sectional view of a drink spout system with another air return system constructed according to the present invention.
Figure 8:
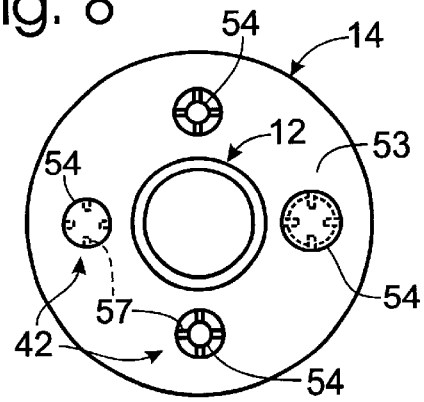
FIG. 8 is a top plan view of the drink spout system of FIG. 7, with the dispensing portion schematically illustrated.

In FIGS. 7–10, additional examples of drink spout systems with air return systems 40 are shown. In FIGS. 7 and 8, the air return system includes an inlet 44 formed in the upper surface 53 of body portion 14, which as shown, is adapted for use on a drink bottle. System 40 further includes a cover 54 that is supported above the inlet of the air return system. As shown, a plurality of supports 57 extend between cover 54 and upper surface 53. As perhaps best seen in FIG. 8, cover 54 takes the form of a surface that at least partially extends over inlet 44. However, it is within the scope of the present invention that cover 54 may have any suitable shape that prevents a user's lips from blocking inlet 44 when drink spout system 10 is used. For example, cover 54 may be simply a member or framework of members extending above inlet 44. As further examples, cover 54 may be smaller than inlet 44, such as shown in FIG. 7, as large as inlet 44, or larger than inlet 44. Illustrative examples of these sizes for cover 54 relative to inlet 44 are shown in FIG. 8, in which it should be understood that a drink spout system will typically include a single size of cover and corresponding inlet. In FIG. 8, a plurality of inlets 44 are shown radially spaced around dispensing portion 12. It should be understood that the number of inlets may vary, from a single inlet, to multiple inlets. As discussed in more detail herein, when drink spout system 10 is adapted to have a direction independent air return system 40, the air return system 40 will typically include at least three radially spaced-apart inlets.

Figure 9:
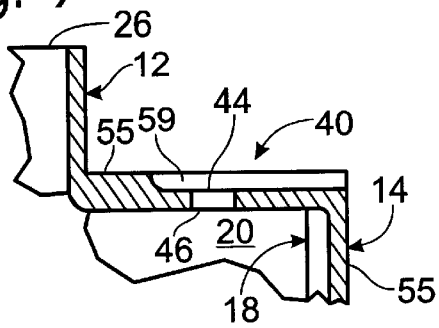
FIG. 9 is a fragmentary, partial cross-sectional view of a drink spout system with another air return system constructed according to the present invention.
Figure 10:
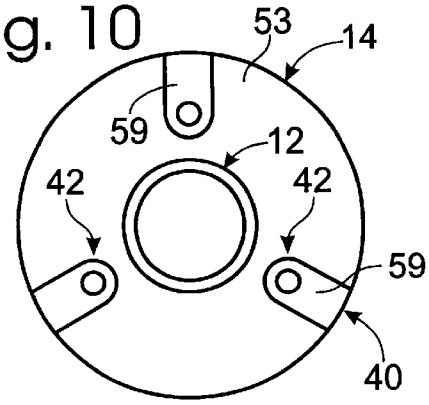
FIG. 10 is a top plan view of the drink spout system of FIG. 9, with the dispensing portion schematically illustrated.

In FIG. 9, another example of an air return system 40 is shown and demonstrates an additional mechanism to prevent or reduce the likelihood of a user's lips from blocking the inlets of the air return system. As shown, system 40 includes a channel or recess 59 in the upper surface 53 of base portion 14. Channel 59 is larger than inlet 44 so that air may still flow into inlet 44 even if a portion of channel 59 is obstructed by a user's lips. In the illustrated embodiment, channel 59 is also open laterally to the sidewall 55 of the base portion to further reduce the likelihood that a user's lips may obstruct the flow of air into inlet 44. It is within the scope of the present invention that channel 59 may not be open laterally to sidewall 55. In FIG. 10, a plurality of channels 59 and corresponding inlets are shown radially spaced around the dispensing portion 12 of the drink spout system.

In FIGS. 7–10, drink spout systems 10 are shown with body portions 11, and more particularly, base portions 14 that are adapted to be mounted on a drink container in the form of a drink bottle with a relatively narrow neck. It should be understood that the air return systems shown in FIGS. 7–10 may be used on any of the embodiments of the drink spout systems and drink containers shown and described herein.

As air is introduced into compartment 20 by air return system 40, it will either be introduced into a region of compartment 20 that is already occupied by air, or it will be introduced as air bubbles into a region of compartment 20 that is occupied by drink fluid 22. For example, when drink container 18 is oriented at an angle relative to a vertical orientation, oriented downward or oriented at a downward angle, air will typically be introduced into a region of compartment 20 that is occupied by drink fluid. Because the air bubbles are introduced in the drink fluid and the drink fluid is being drawn into the drink spout system to be dispensed to a user, there is a tendency for the air bubbles to be dispensed through valve assembly 16 along with the drink fluid. If this occurs, it reduces the flow rate of drink fluid received by the user and may introduce air into a user's stomach. Neither of these events is desirable.

In view of this, air return system 40 may, but does not necessarily, further include a flow restrictor 60. Flow restrictor 60 is adapted to prevent, or reduce the likelihood of, air bubbles returned by system 40 from being recycled, or dispensed, through dispensing portion 12 as the user is drinking from the dispensing portion. Flow restrictor 60 may also be referred to as a bubble barrier, in that it restricts air bubbles introduced into the drink container through air return system 40 from being recycled into fluid conduit 66. A flow restrictor may be desirable when the air return system and dispensing portion share a common opening in the drink container. For example, a flow restrictor may be especially desirable, although not required in all embodiments, with drink bottles in which the opening of the bottle is relatively narrow or confined, thereby introducing air bubbles in close lateral proximity to inlet 64.

Flow restrictor 60 includes any suitable structure designed to separate the return air stream from the stream of drink fluid that is being dispensed from the container. It should be understood that once introduced into drink fluid in compartment 20, an air bubble will travel through the drink fluid along a path dictated by the gravitational and buoyant forces exerted on the air bubble, forces imparted to the air bubble by the drink fluid being drawn into and through the drink spout system, and the shape of the drink container with which the air bubble comes into contact. Generally speaking, air bubbles will tend to rise and travel along the portions of the drink container with which they come into contact. Therefore, a flow restrictor may be shaped or positioned to direct the path of the air bubble, with the goal being to cause the air bubble to not reach a position in which it will be drawn through inlet 64. Flow restrictor 60 may accomplish this goal either directly, by defining a particular path or conduit along which the air bubbles will travel, or indirectly, by obstructing the path of the air bubble to cause the restrictor to impede the flow of the air bubble along the path it would otherwise follow if the obstruction was not present.

Examples of suitable flow restrictors 60 include partitions 61 or sleeves 62 that extend into drink container 18 a sufficient distance to at least substantially, or completely, block the flow of air bubbles from outlet 46 to the inlet 64 of the drink spout system's dispensing fluid conduit 66. Partitions 61 and sleeves 62 may have a variety of configurations, such as tubes and portions thereof, baffles, internal walls, and the like. Preferably, the flow restrictors are shaped to prevent all or at least a substantial portion of the air bubbles returned by air return system 40 from being drawn into inlet 64, regardless of the radial orientation of the drink container about a central axis extending in the direction of fluid flow through its dispensing portion.

Illustrative examples of suitable flow restrictors 60 are shown in FIGS. 4–6. As shown, flow restrictors 60 may extend between outlet 46 of air return system 40 and inlet 64 of valve assembly 16, partially or completely around outlet 46, or partially or completely around inlet 64. It should be understood that the length of the flow restrictors 60 shown in FIGS. 4-6 are shown for purposes of illustration and that the flow restrictors may be formed with different lengths.

In FIG. 4, an example of a flow restrictor is shown in the form of a partition 61 that separates, along the length of the partition, the drink fluid being dispensed from the drink spout system and the air being returned to the drink container. Preferably, the partition extends completely between the sidewalls of the drink container along its length so that air bubbles cannot pass laterally around the partition. More particularly, in the orientation shown in FIG. 4, the partition preferably provides a boundary that extends partially or completely between generally opposing sidewalls of the drink container. When the partition extends completely between the opposed sidewalls of the drink container, it requires air bubbles to pass downwardly along the length of the partition and then around the bottom portion of the partition before being able to enter inlet 64. When a partial barrier is formed, the air bubbles still must travel around the partition, which should be sized to divert the air bubbles toward the sidewalls of the drink container and/or away from inlet 64.

In FIG. 5, an example of a flow restrictor 60 that includes a sleeve 62 that defines a fluid conduit around inlet 64 is shown. As shown, the sleeve includes an inlet 68, through which drink fluid is drawn into the sleeve, where it may travel through a fluid conduit 67 that is defined at least in part by the flow restrictor. Fluid conduit 67 may at all times be in fluid communication with dispensing fluid conduit 66, such as when the drink spout system does not include a valve assembly 16, or may be selectively in fluid communication with dispensing fluid conduit 66, such as when the valve assembly is in its dispensing position.

Also shown in dashed lines in FIG. 5 at 63 are flanges that extend radially outward from at least a portion of flow restrictor 60 to increase the path along which an air bubble travels and/or to direct the air bubble radially around the sleeve instead of along the sleeve. For example, consider the embodiment of drink spout system 10 shown in FIG. 5. When the system is rotated counterclockwise by at least 90°, air returned by system 40 will generally take the form of bubbles introduced into drink fluid 22. The air bubbles will tend to flow upward because of the buoyant force on the bubbles. When the bubbles strike or approach sleeve 62, they will tend to flow radially around the sleeve. Depending upon the angle of the drink container, the bubbles may also tend to flow along the surface of the sleeve. The use of one or more flanges 63 provides an additional obstruction, or flow-restricting device, that directs the air bubbles away from a position where it may be dispensed from the drink spout system along with the drink fluid.

A pair of flanges 63 are shown in FIG. 5 for purposes of illustration, and it should be understood that the flow restrictor may include as few as zero or one flange, as well as a plurality or multiplicity of flanges spaced along the length of the partition or baffle forming flow restrictor 60. Preferably, flange 63 extends radially away from the flow restrictor's sleeve or baffle in a direction generally toward the outlets 46 of air return passages 42 so that the flanges are positioned to interact with the returned air bubbles. When air return system 40 includes two or more outlets, it may be desirable for flanges 63 to extend at least substantially or completely around the sleeve or partition.

In FIG. 6, an example of a flow restrictor is shown that includes a sleeve that defines a fluid conduit around outlet 46 of air return system 40. A flange 63 is also shown in FIG. 6 to indicate that one or more flanges may also be used with embodiments of flow restrictor 60 that define a sleeve around the outlet or outlets of air return system 40.

Figure 11:
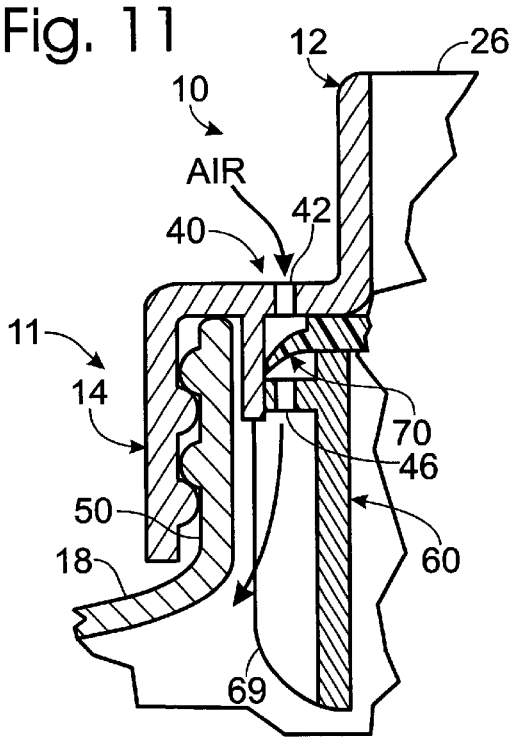
FIG. 11 is a cross-sectional view of a drink spout system constructed according to the present invention and including an air return system and flow restrictor according to the present invention.
Figure 12:
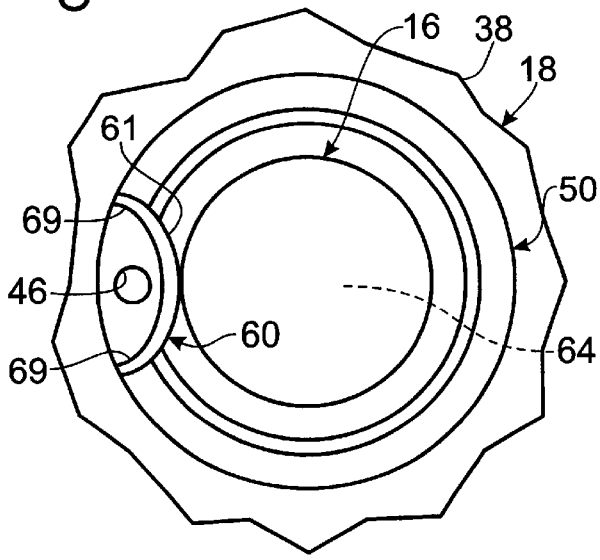
FIG. 12 is a fragmentary cross-sectional view of a drink spout system with another air return system and flow restrictor according to the present invention.

In FIGS. 11 and 12, another example of a flow restrictor 60 is shown. As shown, flow restrictor 60 takes the form of a partition 61 that defines with neck 50 of drink bottle 38 a partial or complete sleeve through which air bubbles flow, such as perhaps best seen in FIG. 12. In the illustrated embodiment, partition 61 has a generally concave configuration relative to the neck of the drink container, in that the partition has lateral edges 69 that extend toward or to the sidewalls of the drink container.

Air return systems and air return systems that include a flow restrictor 60 may be either direction independent or direction specific. By direction independent, it is meant that the air return system may perform the same or essentially the same regardless of the radial orientation of drink container 18 relative to the direction of fluid flow through the drink spout system. By direction specific, it is meant that the performance of the air return system is dependent at least in part upon the radial orientation of the drink spout system relative to the direction of fluid flow through the drink spout system. For example, examples of drink spout systems with air return systems that are direction specific are shown in U.S. Pat. Nos. 5,890,620 and 6,0789,589, the complete disclosures of which are hereby incorporated by reference for all purposes. In the drink spout systems shown in both of these patents, the air return system will introduce air bubbles from only a single position relative to the fluid conduit of the drink spout system and the air return systems do not include flow restrictors 60. Therefore, the air bubbles will simply flow along the path dictated by the forces exerted upon the bubbles. Therefore, if the drink container is oriented with the air return system above the dispensing portion, the air bubbles will be less likely to enter the fluid conduit, and if the drink container is oriented with the air return system below the dispensing portion, the air bubbles will tend to enter the fluid conduit.

The drink spout systems shown in FIGS. 7–12 illustrate examples of drink spout systems with air return systems that may be direction independent, even if the air return system does not include a flow restrictor. More specifically, these drink spout systems contain air return systems that have a plurality of outlets 46 radially spaced apart around the dispensing portion of the drink spout system. More specifically, although at least one of outlets 46 may be below or generally below the inlet to the dispensing portion, there will also be others that are above the inlet. Because air entering compartment 20 via the air return system will follow the path of least resistance, it will tend to enter through the outlets positioned above the dispensing portion, especially if the outlets introduce the air into a region of the drink container that already contains air instead of drink fluid. When air return system 40 includes a flow restrictor, it may be direction independent even if the air return system only includes a single outlet 46 because the flow restrictor directs or defines the path of any air bubbles introduced into the drink fluid to prevent the air bubbles from being dispensed through the drink spout system with the drink fluid.

Air return system 40 may further include a return valve assembly 70 that is selectively configurable between a dispensing position, in which air may enter the drink container through the air passage(s) 42 while fluid is being dispensed through the drink spout system, and a closed position, in which air (or drink fluid) may not pass through the air passage(s). Return valve assembly 70 may have any suitable form and components, including those discussed, illustrated and incorporated therein with respect to valve assembly 16. For example, the return valve assembly may include a pressure-differential valve assembly that automatically returns to the closed position, thereby preventing drink fluid from being able to pass through passage 42. It is within the scope of the present invention that valve assembly 16 and return valve assembly 70 may be integrally formed or separately formed.

Figure 13:
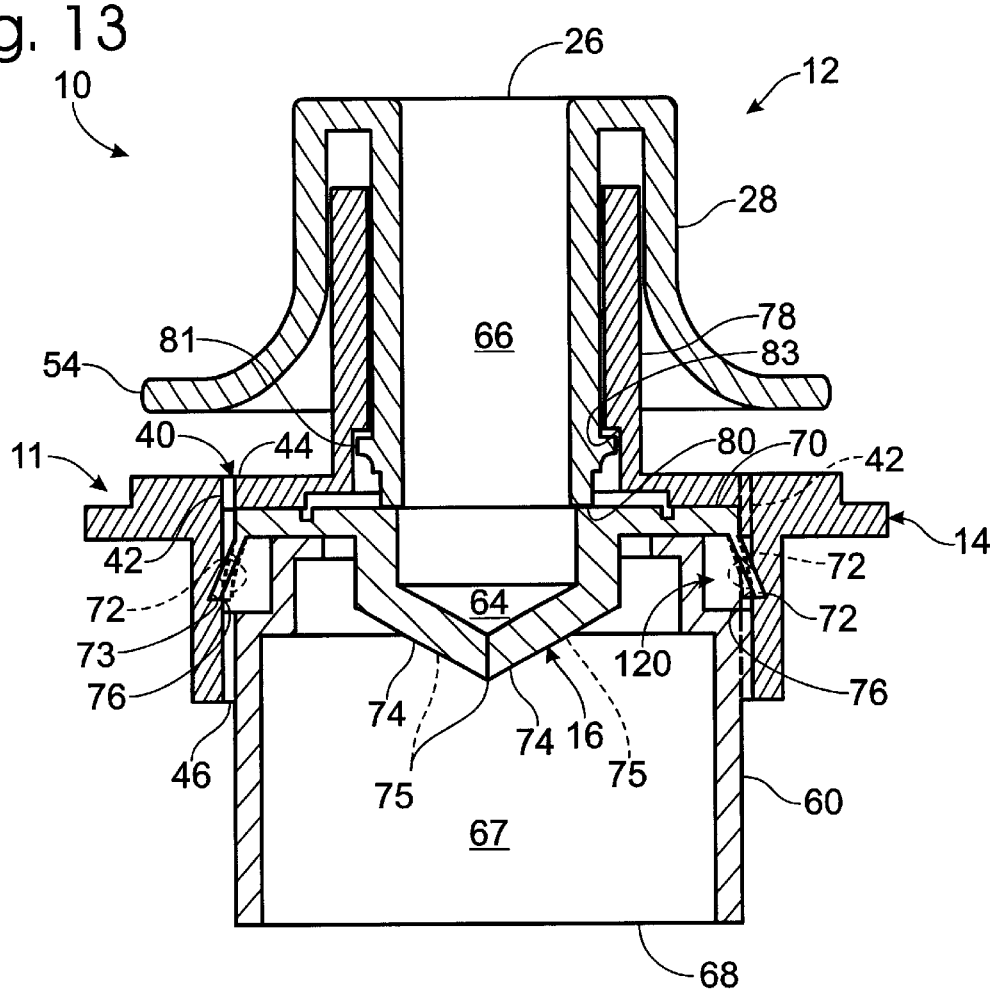
FIG. 13 is a fragmentary bottom plan view of the drink spout system and flow restrictor of FIG. 12.
Figure 15:
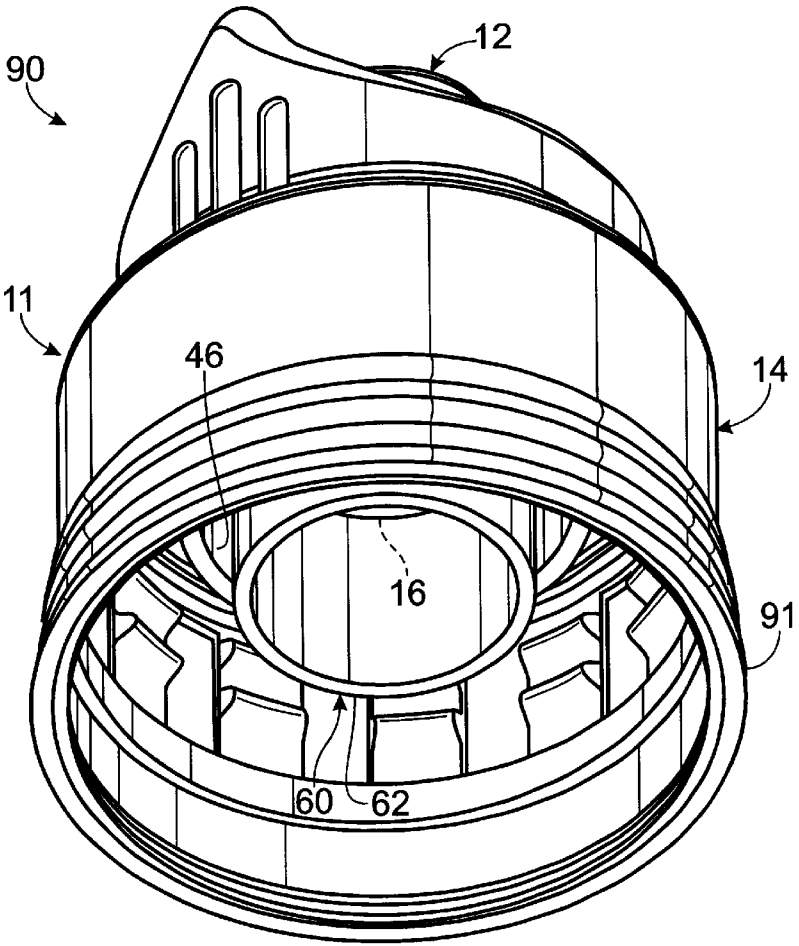
FIG. 15 is a bottom perspective view of the drink spout system of FIG. 14.
Figure 14:
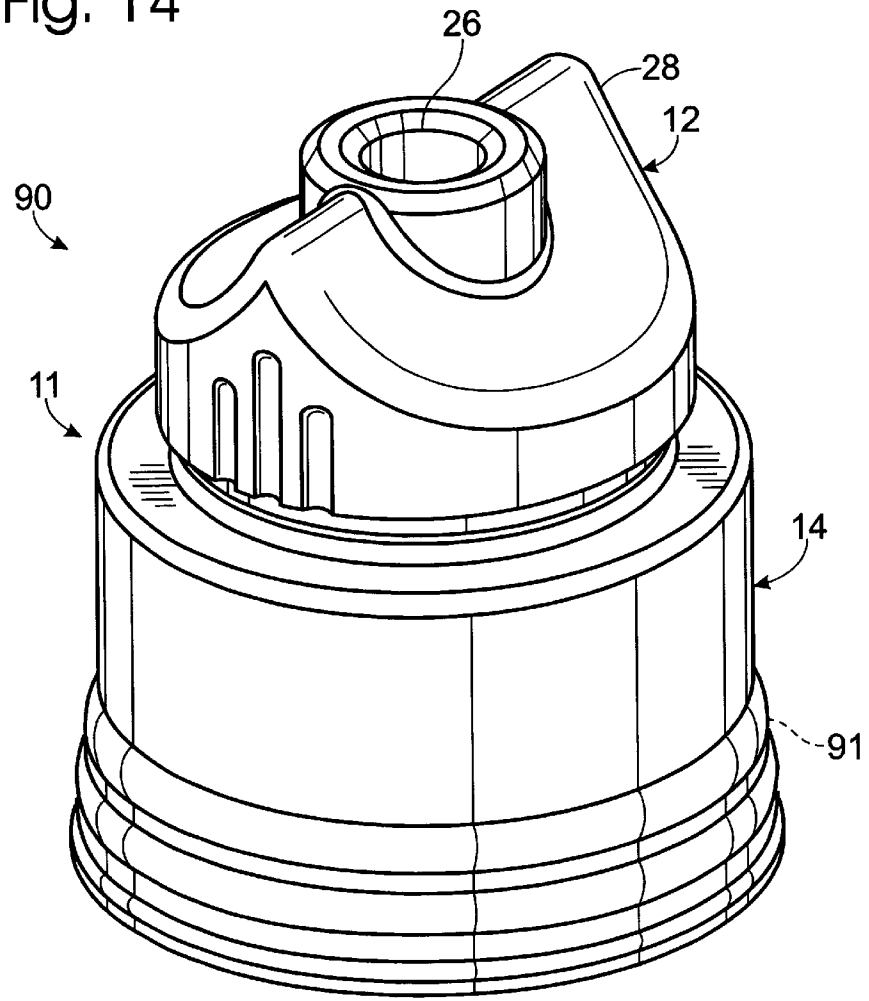
FIG. 14 is a top perspective view of another drink spout system constructed according to the present invention.

An example of a drink spout system containing an air return system 40 having a return valve assembly 70 is shown in FIG. 13. As shown, the drink spout system includes a self-sealing valve assembly 16 that is formed from an elastomeric material, which deflects away from outlet 26 upon urging of mouthpiece 28 generally toward the valve assembly. When this occurs, the dispensing portion slides along guide portion 78 and a lower portion 80 of the dispensing portion engages valve assembly 16 to deform the valve assembly to, or toward, its dispensing position. When the user-applied force to dispensing portion 12 is removed, the valve assembly is biased to return to its closed position, with one or more projections 81 on the dispensing portion engaging one or more corresponding stops 83 on base portion 14 to limit the movement of the dispensing portion away from the drink container. In FIG. 13, air return system 40 is shown having at least a pair of air passages 42, and mouthpiece 28 provides a cover 54 that prevents the inputs of the air passages from being obstructed when a user drinks from the spout system. In FIG. 13, one of the air passages is shown in dashed lines to indicate that the passages may be radially spaced around the base portion, and that at least two such passages may be used. It should be understood that the illustrated embodiment is generally cylindrical in shape, and that the air return system may include additional passages 42 spaced radially or otherwise around fluid conduit 66.

As discussed, the illustrated embodiment also provides an example of an air return system 40 that includes a return valve assembly 70. It should be understood that the drink spout system of FIG. 13 may be formed without a return valve assembly, without an air return system, or without a valve assembly 16, as discussed herein. In the illustrated embodiment, valve assembly 16 and return valve assembly 70 are integrally formed, with each valve assembly including respective portions 72 and 74 that are adapted to deflect from their closed positions responsive to the pressure differential established when drink fluid is dispensed from the drink container and to user-applied forces to the drink spout system, respectively. In its closed position, portions 72 of return valve assembly 70 are adapted to engage and extend at least partially against base portion 14, and more specifically an interior, or inner, sidewall 76 thereof. It should be understood that portions 72 may be radially spaced-apart regions of return valve assembly 70, or alternatively, may be a continuous ring or skirt of elastomeric material.

To illustrate their biased configuration, portions 72 have been illustrated as extending into the sidewall to represent the neutral position of portions 72. Preferably, these portions cannot reach their neutral positions in an actual embodiment of the return valve assembly, and therefore the portions are preloaded, or biased against, the corresponding portion of base portion 14, such as shown in dashed lines. This provides a tighter seal in the closed position. Alternatively, the base portion may include a recess 73 that is shaped to receive the terminal regions of portions 72, as shown in solid lines in FIG. 13. It should be understood that valve assembly 16 may be similarly preloaded. Similarly, portions 74 are biased against each other to close slits 75 that are formed between the portions.

Also shown in FIG. 13 is another example of a flow restrictor 60. In the illustrated embodiment, restrictor 60 extends generally around inlet 64 of fluid conduit 66 so that air bubbles introduced through air passages 42 are not drawn into the fluid conduit as a user drinks from dispensing portion 12. The length of restrictor 60 may vary, depending upon such factors as the shape and size of the drink container and fluid conduit 66, the flow rate of drink fluid being dispensed through drink spout system 10, the intended orientation of the drink container when spout system 10 is used, etc. As shown, restrictor 60 includes a restrictor inlet 68 through which drink fluid must pass prior to entering fluid conduit 66. Alternatively, the restrictor may extend around the air return system and have an outlet through which air bubbles must pass, such as illustrated previously with respect to FIG. 6. In such an embodiment, the restrictor is preferably located sufficiently distal inlet 64 that the air bubbles are not drawn into the fluid conduit.

Another example of a drink spout system according to the present invention is shown in FIGS. 14–21 and generally indicated at 90. As perhaps best seen in FIG. 15, system 90 includes a base portion 14 that is adapted to be mounted on a drink container in the form of a drink bottle and as such includes a threaded neck 91 that is adapted to be screwed onto a drink bottle having a corresponding set of threads. It should be understood that system 90 may be mounted on other drink containers, such as bottles having different configurations, drink pouches and drink bottles. It should be similarly understood that the base portion of system 90, and the other drink spout systems disclosed and illustrated herein, may vary, such as depending upon the particular drink container with which the drink spout system is used.

Drink spout system 90 further includes a valve assembly 16 that is formed from an elastomeric material and which is adapted to be urged to its dispensing position by user-applied forces to dispensing portion 12. More specifically, when a user urges dispensing portion 12 toward or generally toward valve assembly 16, the dispensing portion engages the valve assembly and deflects the valve assembly from its closed position to its dispensing position, such as discussed above with respect to the drink spout system shown in FIG. 13 and incorporated by reference herein. System 90 includes a locking mechanism 92 and as such is selectively configurable between an open, or unlocked configuration, in which the valve assembly may be urged to its dispensing position and drink fluid may be dispensed from the system, and a locked configuration, in which the valve assembly cannot be configured to its dispensing position until the lock mechanism is returned to its unlocked configuration. An advantage of a drink spout system that includes a locking mechanism is that unintentional dispensing of drink fluid from the system is prevented, even if the drink spout system has been previously used and the seal portion, if any, of the system has been pierced. For example, if the drink container and spout system have previously been used and then are going to be set down, placed in a backpack, gym bag, or other container, the system may be configured so that forces that would otherwise cause drink fluid to be dispensed through outlet 26 are prevented from doing so. Similarly, the lock mechanism enables the dispensing of drink fluid to be prevented without requiring a cap or other cover that is removable from the drink spout system and thereby may be lost or requires a lanyard to tether the cap to the drink spout system.

Figure 16:
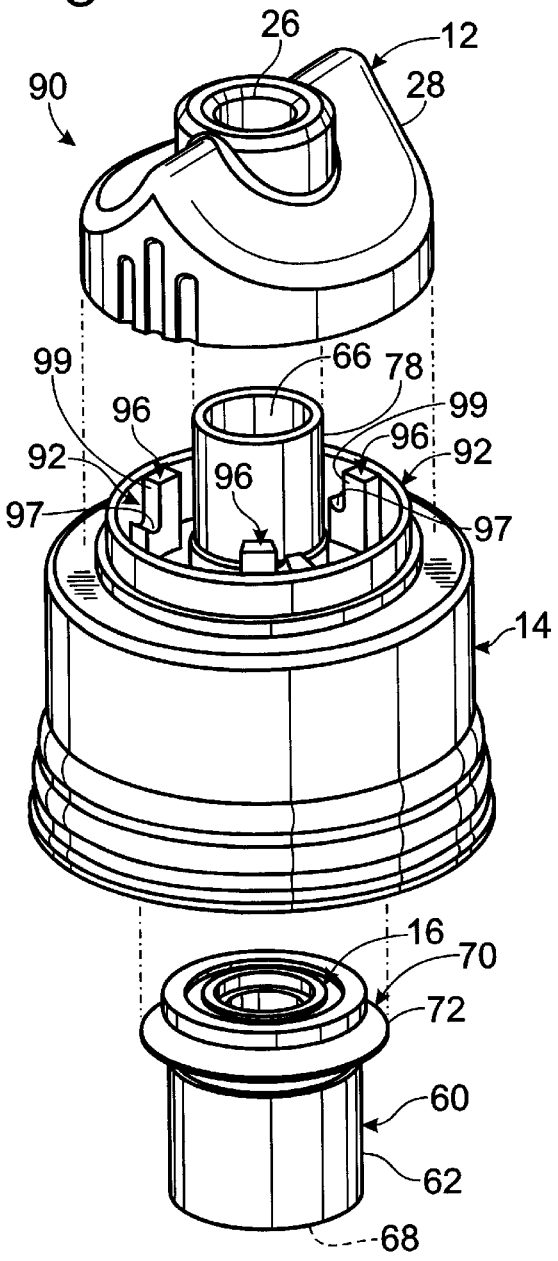
FIG. 16 is an exploded top perspective view of the drink spout system of FIG. 14.
Figure 17:
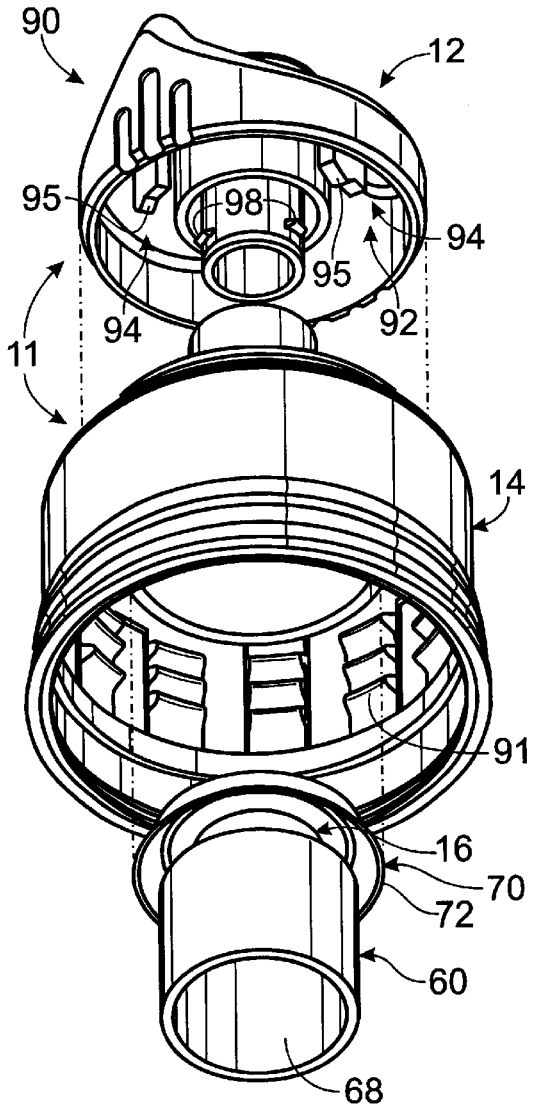
FIG. 17 is an exploded bottom perspective view of the drink spout system of FIG. 14.
Figure 19:
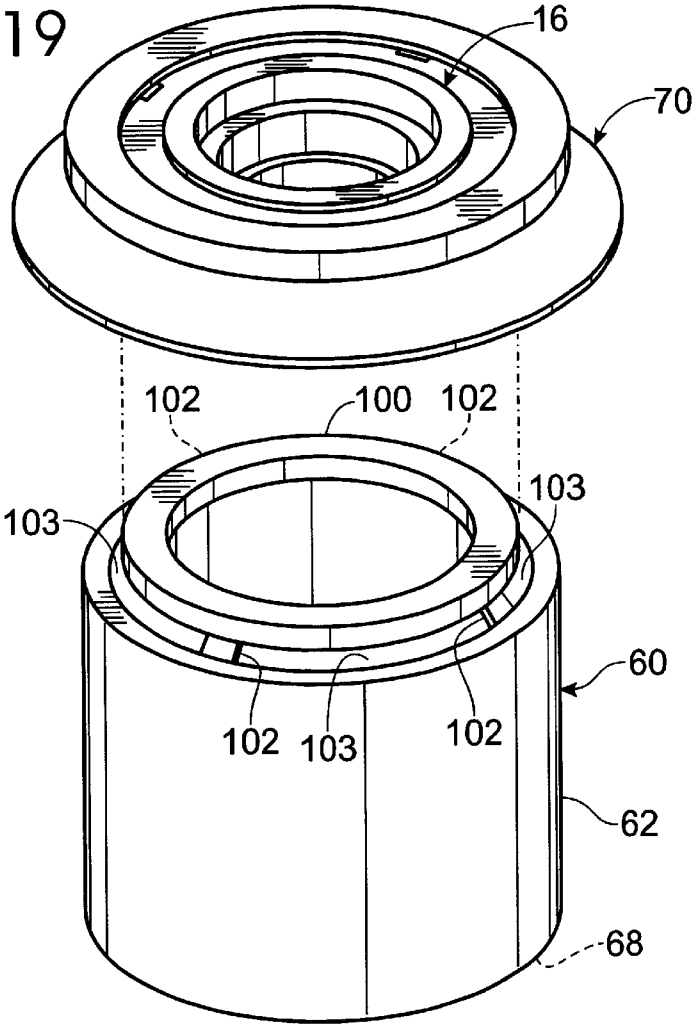
FIG. 19 is an exploded top perspective view of the flow restrictor and valve assembly of the drink spout system of FIG. 14.
Figure 18:
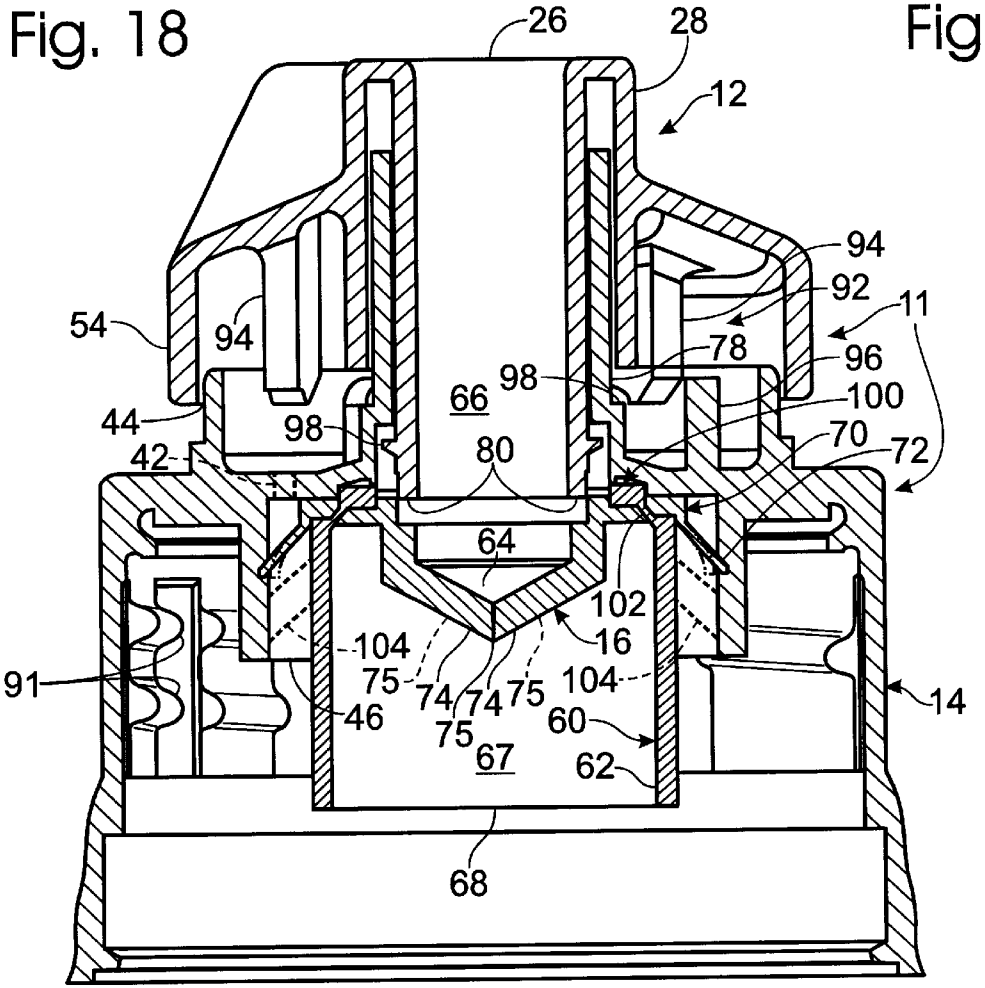
FIG. 18 is a cross-sectional view of the drink spout system of FIG. 14.
Figure 21:
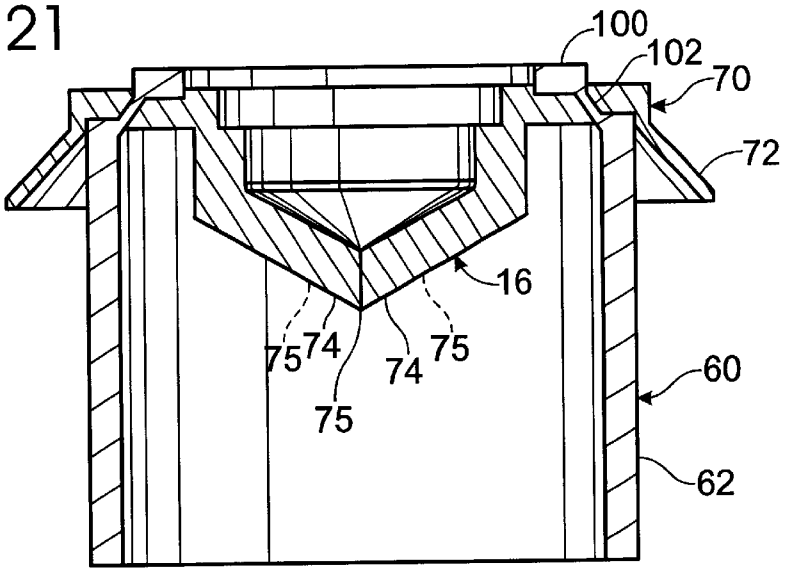
FIG. 21 is a cross-sectional view of the flow restrictor and valve assembly of FIG. 19.

In the illustrated embodiment shown in FIGS. 16–18, locking mechanism 92 includes corresponding members 94 and 96 on the dispensing and base portions of the drink spout system. As perhaps best seen in FIGS. 16 and 17, respectively, member 96 includes a seat 97 and a stop 99, and member 94 includes a catch 95 that is adapted to be selectively received into seat 97, thereby defining the locked configuration of mechanism 92. More specifically, as the base and dispensing portions are rotated relative to each other, catch 95 and seat 97 eventually abut each other. Further urging of the portions in the same rotational direction will cause the catch to extend into the seat, thereby retaining the portions together until the portions are rotated in the opposite direction with enough force to unseat the catch from seat 97. Stop 99 prevents the catch from being removed from the seat by over-rotating the portions. Stop 99 may also be described as limiting the degree of rotation of the members relative to each other.

Preferably, a user may determine the configuration of the lock mechanism by feel, simply by trying to rotate the dispensing portion relative to the base portion. If the portions rotate easily, then the lock mechanism is in its unlocked configuration. If the portions resist rotation, then the lock mechanism is in its locked configuration. In some embodiments, the lock mechanism may, but does not necessarily, emit an audible sound when the catch is seated into seat 97, thereby providing an audible indicator to a user that the lock mechanism is in its locked configuration.

It should be understood that the particular configuration of members 94 and 96 is but one illustrative example of a suitable construction for lock mechanism 92. Furthermore, it is within the scope of the invention that lock mechanism 92 (and members 94 and 96) may have any suitable structure that is adapted to perform the function described above. Examples of variations to the above-described embodiment include placing one or more of members 94 on base portion 14 and one or more of members 96 on dispensing portion 12, forming all or at least one of members 96 without stop 99, forming all or at least one of members 94 with a stop 99 to limit the relative rotation of the members, and/or substituting the positions of all or one of the seats and catches. Similarly, although lock mechanism 92 is illustrated with three sets of members 94 and 96, any selected number of such members may be used, from a single one of each member, to more than three of each member. In a further variation, portions 12 and 14 may have a different number of the corresponding portions 94 and 96, such as one of portions 12 and 14 having only a single member (94 or 96), and the other having a plurality of the other member. In such an embodiment, the members should be formed without stops 99 so that the members may rotate in a complete or at least substantially complete revolution relative to each other.

When members 94 and 96 are rotationally aligned for engagement with each other, drink spout system 90 is in its locked configuration. In this configuration, the members may also be described as at least partially overlapping with each other so that forces, such as user-applied forces, that would otherwise urge the dispensing portion toward the valve assembly and thereby configure the drink spout system to its dispensing orientation, instead only cause members 94 and 96 to be pressed more firmly against each other. The engagement of these members prevents these forces from being applied to the valve assembly, thereby retaining the valve assembly in its closed position. When the members are not aligned for engagement with each other, the dispensing portion may be urged toward the drink container and thereby configure the drink spout system to its dispensing orientation. It should be understood that other configurations for locking mechanism 92 may be used, and that the other drink spout systems shown, described and incorporated herein may also include a locking mechanism. Also shown in FIG. 18 are projections, or stops, 98 that define the upper and lower range of travel of dispensing portion 12 relative to base portion 14.

Similar to the drink spout system shown in FIG. 13, system 90 may be referred to as a push-to-drink spout in that the valve assembly is actuated by a user urging dispensing portion 12 generally toward the drink container, such as with the user's teeth or lips as the user drinks from the dispensing portion. In the illustrated embodiment shown in FIGS. 16–18, it can be seen that the drink spout system includes a return valve assembly 70 that is integrally formed with valve assembly 16. Although the assemblies may be separately formed and/or installed, forming the assemblies together enables them to be installed as a unit. In many embodiments, this produces an integrated valve assembly that is more durable and easier to install than two separately formed and installed valve assemblies.

Drink spout system 90 also provides an illustrative example of a drink spout system having components formed from two-shot molding or a similar molding process. Two-shot molding may also be referred to as overmolding, insert molding, or more generally as co-molding. For example, as perhaps best seen in FIGS. 19–21, flow restrictor 60 includes a sleeve 62 and a mount 100 that is spaced apart from sleeve 62 by supports 102 that define apertures 103 therebetween. Valve assemblies 16 and 70 collectively extend around the supports and through apertures 103, with valve assembly 16 extending internal of sleeve 62 and return valve assembly 70 extending external sleeve 62. Valve assemblies 16 and 70 are typically formed from an elastomeric material, such as silicone or a thermoplastic elastomer, with the rest of the drink spout system being formed from a relatively hard plastic material, such as polypropylene, that retains its shape during normal use of the drink spout system. It should be understood that two-shot molded components are not required and that any other suitable mechanism for coupling together components of the drink spout systems may be used, such as heat sealing, adhesives, mechanical fasteners and the like.

As perhaps best seen by returning to FIG. 18, valve assembly 16 is urged to its dispensing position when lower portion 80 of dispensing portion 12 engages the valve assembly internal mount 100. Mount 100 also provides an illustrative example of a suitable structure for including a preload mechanism for at least valve assembly 16. Preload mechanisms are discussed in more detail subsequently. Mount 100 also provides an illustrative example of a suitable structure to couple the flow restrictor, which may have any of the previously discussed structures, to the rest of base portion 14. Alternatively or additionally, spaced-apart vanes or other supports 104 may extend between the base portion and flow restrictor, such as schematically illustrated in dashed lines in FIG. 18.

As discussed previously with respect to the drink spout system shown in FIG. 13, drink spout systems according to the present invention may include a valve assembly 16 and/or return valve assembly 70 that include a preload mechanism 120. By "preload" or "preloaded," it is meant that the valve assemblies are biased toward a neutral position that is not obtained during normal operation of the valve assembly. Because of this, the preloaded portions exert a stronger sealing force against the structure that they engage in the closed position and thereby provide a better seal against unintentional passing of fluid through the valve assembly. Although valve assemblies including one or more slits that are made during manufacturing of the valve assembly are within the scope of the invention, preloaded valve assemblies offer the advantages that they are biased to return beyond a closed position, instead of to or toward the closed position. In some embodiments, this may enable less expensive materials, such as thermoplastic elastomers, to be used to form the corresponding valve assembly because the seal of the valve assembly is enhanced, or strengthened, by the preload mechanism.

In the example shown in FIG. 13, portions 72 of return valve assembly 70 are sized and oriented in a configuration in which portions 72 are larger than the corresponding passage in air return passage 42. Because of this, portions 72 are deflected from their neutral positions, even when the return valve assembly is in its closed position. When the valve assembly is in its dispensing position, in which air passes through passage 42 into drink container 18, portions 72 are further deflected away from their neutral positions.

Figure 22:
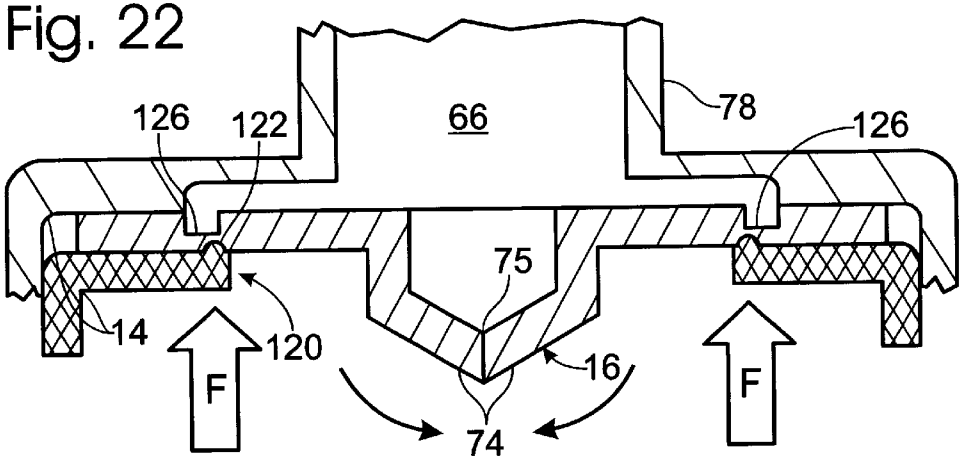
FIG. 22 is a fragmentary cross-sectional view of a drink spout system according to the present invention that includes a preloaded valve assembly.

Another example of a preload mechanism 120 is shown in FIG. 22 and illustrated with respect to valve assembly 16. As shown, base portion 14 includes a preload mechanism 120 in the form of a projecting member 122 on base portion 14 that exerts a biasing force F on the valve assembly to urge portions 74 of the valve assembly toward, and even beyond, the closed position shown in FIG. 22. Member 122 may have any suitable shape adapted to provide the above-described preloading on the valve assembly. For example, member 122 may be a continuous or intermittent ridge, plurality of projections or the like.

Figure 23:
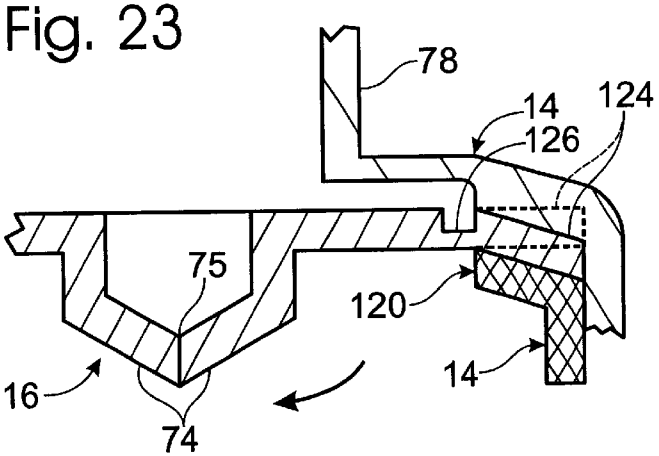
FIG. 23 is a fragmentary cross-sectional view of another drink spout system according to the present invention that includes a preloaded valve assembly.
Figure 20:
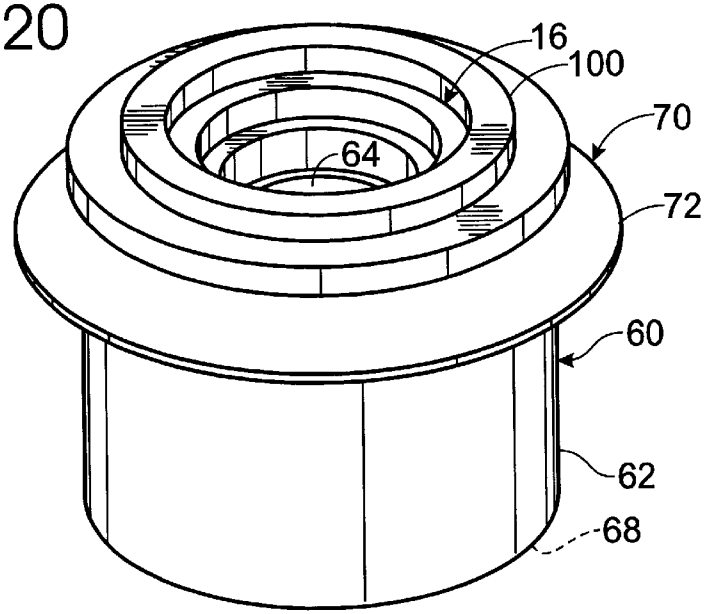
FIG. 20 is an assembled view of the flow restrictor and valve assembly of FIG. 19.

Another example of a suitable preload mechanism 120 is shown in FIG. 23 and illustrated with respect to valve assembly 16. As shown, the valve assembly includes a peripheral flange 124 that is mounted to base portion 14 in a deflected orientation. For purposes of illustration, the neutral, or unbiased, orientation of flange 124 is shown in dashed lines in FIG. 23. Because the flange cannot move relative to the portion to which it is mounted, the rest of the valve assembly is thereby biased toward a neutral position that is beyond its closed position. By "beyond its closed position," it is meant that the flaps or other corresponding portions of the valve assembly remain biased even when in their closed positions. Therefore, the portions are adapted to continue moving in the biased direction if the corresponding structure that prevents this movement in the closed position is removed. By comparison, a generally planar disc of elastomeric material that is sliced to form one or more slits will be biased to return to its generally planar configuration (when urged or deflected away from this configuration), but the portions defined by the slits are not biased against each other, or beyond their closed position.

Figure 24:
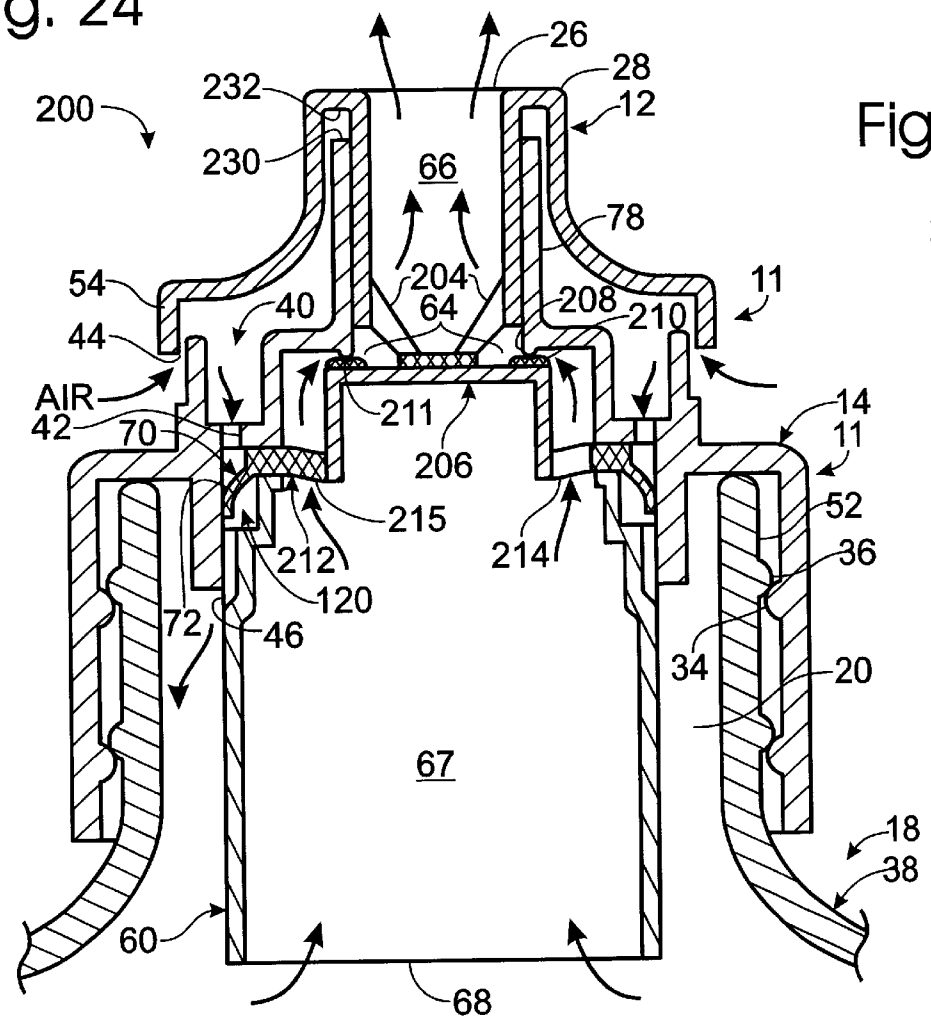
FIG. 24 is a cross-sectional view of a drink spout system according to the present invention that includes a plug valve assembly shown in its closed position.

Another example of a drink spout system constructed according to the present invention is shown in FIG. 24 and generally indicated at 200. Similar to the previously described embodiments, system 200 includes a dispensing portion 12, base portion 14 and valve assembly 16. In the illustrated embodiment, system 200 is shown including an air return system 40, a flow restrictor 60, and a return valve assembly 70. However, and as discussed previously, it should be understood that system 200 may be formed without some or all of the components, and that system 200 may include any of the variations and features described, illustrated and/or disclosed herein.

System 200 may be referred to as including a valve assembly 16 in the form of a "plug" valve assembly because the valve assembly includes a seal formed by the engagement of corresponding portions of the drink spout system that are biased into engagement with each other by a biasing mechanism. In the illustrated embodiment, dispensing portion 12 is coupled to a plug member 206 around which the inlet 64 of fluid conduit 66 is defined. In the closed position shown in FIG. 24, it can be seen that plug member 206 engages a seal region 208 on base portion 14 to provide a seal through which drink fluid cannot be dispensed when the dispensing system is in its closed position. When the dispensing portion is urged toward base portion 14 (or the valve assembly), such as by a user pressing on the dispensing portion with the user's mouth, the user-applied forces are transmitted to the plug member to urge the plug member away from contact with seal region 208, thereby defining a cylindrical inlet 64 through which drink fluid may flow to enter fluid conduit 66. Expressed another way, in its dispensing position, the plug member is spaced-apart from seal region 208 and thereby defines an inlet 64 that extends radially around the cross-sectional area bounded by the seal region and has a height generally defined between the seal region and plug member.

Figure 25:
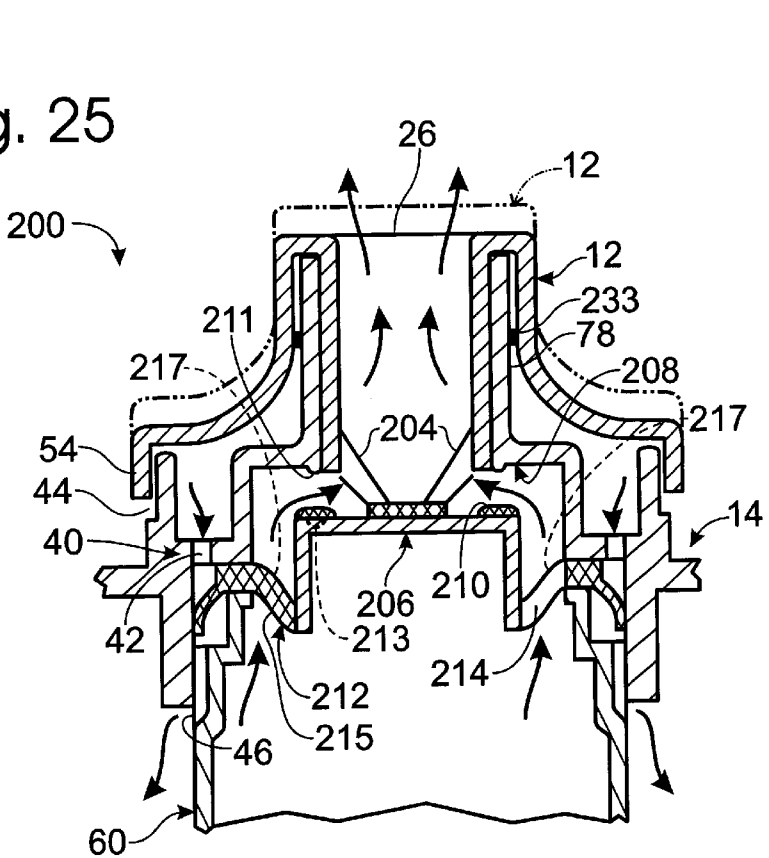
FIG. 25 is a fragmentary cross-sectional view of the drink spout system of FIG. 24, with the plug valve assembly shown in its dispensing position.

The plug valve assembly shown in FIGS. 24 and 25 may also be described as being free from slits, in that the valve assembly does not require a seal formed between opposing portions of an elastomeric membrane that has been cut or slit to provide openings when the membrane is stretched. The plug valve assembly may also be described as preventing spills even if the drink container is squeezed or collapsed, in that forces that would otherwise urge drink fluid to be dispensed from a valve assembly, such as the subsequently discussed suction valve assembly, actually cause the plug valve assembly to form a tighter seal. More specifically if a user sucks on dispensing portion 12, or if drink container 18 is squeezed or partially collapsed, these forces will urge plug member 206 toward seal region 208, which in turn provides a tighter seal. Plug member 206 may also be described as a plunger that is moved into and out of a sealing position responsive to user-applied forces that are adapted to urge the plunger away from its closed (or sealed) position and a biasing mechanism that is adapted to return the plunger to its closed position.

Dispensing portion 12 may be described as including a contactor, or contacting portion, 204 that extends from the dispensing portion and which urges the plug member away from the seal region responsive to user-applied forces to the dispensing portion. In FIG. 24, contactor 204 may be described as including a plurality of spaced-apart vanes, but other structures may be used that meet the criteria set forth above. Contactor 204 may be mounted on both the plug member and the dispensing portion, or even integrally formed therewith. Alternatively, the contactor may be mounted on, or extend from, only one of the dispensing portion and the plug member, with the contactor engaging the other of the plug member and the dispensing portion as the dispensing portion is urged toward the valve assembly, namely toward the drink container on which the drink spout system is mounted.

In the illustrative embodiment shown in FIG. 24, dispensing portion 12 is configured to slide or otherwise move generally toward and away from plug member 206, and body 11 includes a guide portion 78 that guides the movement of the dispensing portion between its dispensing and closed positions. As the dispensing portion is moved generally toward drink container 18, such as toward plug member 206, the dispensing portion urges the plug member away from its closed position. In FIGS. 24 and 25, it can be seen that guide portion 78 includes an upper portion 230 that engages the inner surface 232 of dispensing portion 12. When portion 230 and 232 engage each other, they provide a stop that defines the lower extent to which the dispensing portion may be moved toward the drink container. It is within the scope of the invention, however, that the drink spout system may utilize other structure to limit the degree to which the dispensing portion may be moved toward the drink container, or in the case of a drink spout system with a plug valve assembly, the degree to which the plug member may be urged away from its closed position.

Preferably, drink spout system 200 is configured so that drink fluid cannot pass between dispensing portion 12 and guide portion 78, and thereby be dispensing from the drink spout system through an opening other than outlet 26. Similarly, it is preferable that air from external the drink container cannot pass between the dispensing and guide portions and thereby enter the drink container other than through air return system 40. Accordingly, drink spout systems with movable dispensing portions according to the present invention preferably, but do not necessarily, include a seal between the dispensing and guide portions. For example, upper portion 230 and inner surface 232 may engage each other to form such a seal when the drink spout system is in its dispensing position. Alternatively or additionally, the surfaces of the guide and dispensing portions that extend generally parallel to the direction of fluid flow may form such a seal. As a further example, the drink spout system may include a seal member that extends between portions 12 and 78, such as shown in FIG. 25 at 233. Seal member may be formed from any suitable material that enables portions 12 and 78 to move with respect to each other but which also prevents fluid (such as air or drink fluid) from passing therethrough. Examples of suitable materials include, but should not be limited to, the above-described elastomeric and deflectable materials.

It is further within the scope of the invention, that drink spout system 200 may be configured with a plug valve assembly that is actuated by a mechanism other than moving the dispensing portion generally toward the plug member. For example, the drink spout system may include a manually-depressible element, such as a lever arm or button, that a user presses to urge the plug member to its dispensing position. The element may be pressed by a user's hand that is holding the drink container on which the drink spout system is mounted, and the plug member may return this element to its closed-position orientation when the user releases the element.

In the illustrated embodiment, the plug valve assembly includes a seal member 210 that interconnects and forms a seal between the seal region and plug member when the valve assembly is in its closed position. Examples of suitable seal members 210 include gaskets, washers, fittings and similar structures that are formed of a deformable material and are adapted to provide a fluid-tight seal between seal region 208 and plug member 206. Seal member 210 enables the valve assembly to prevent drink fluid from passing therethrough without requiring a precise fit between member 206 and region 208 by deforming to conform to the contours of members 206 and region 208. Because seal member 210 is deformable, it provides a fluid-tight seal even if there otherwise may be small gaps between member 206 and region 208.

In the illustrated embodiment, seal member 210 is located on plug member 206. However, it is within the scope of the invention that seal member 210 may be mounted on seal region 208 instead of plug member 206, or both region 208 and member 206 may include a seal member 210. It is also within the scope of the present invention that the valve assembly may be formed without seal member 210, and that member 206 and region 208 may be shaped to provide a sufficient seal without seal member 210 being present. In such an embodiment, member 206 and region 208 may have a planar surface of contact. In a variation of this embodiment, one or both of the regions are shaped to provide a non-planar contact region, or contact surface, and thereby provide additional leak prevention to the valve assembly. For example, as perhaps best seen in FIG. 25, seal region 208 includes a projecting member, or ring, 211 that in the illustrated embodiment engages seal member 210. In an embodiment of drink spout system 200 without member 210, plug member 206 may include a corresponding recess or notch 213, which is adapted to receive at least a portion of the ring to provide an improved seal therewith and which is shown in dashed lines in FIG. 25 for purposes of illustration. Similarly, the position of ring 211 and notch 213 may be reversed, or any other suitable configuration for the mating surfaces of seal region 208 and plug member 206 may be used.

Member 206 is biased to the closed position shown in FIG. 24 by a biasing mechanism 212, which as shown urges the plug member toward outlet 26 and into engagement with region 208. Any suitable biasing mechanism may be used that urges the plug member into a sealing engagement with region 208, yet is sufficiently deflectable to permit the drink spout system to be configured to its dispensing position, which is shown in FIG. 25. As shown, biasing mechanism 212 includes a portion 215 that interconnects the plug member with the body of the drink spout system for movement of the plug member between its closed and dispensing positions. Portion 215 may be formed from any suitable material that enables the portion to repeatedly deflect to enable the plug member to move away from its closed position, and then return the plug member to its closed position when user-applied forces to the dispensing portion are removed. Portion 215 may be at least partially, substantially or completely, formed from an elastomeric material. However, it is within the scope of the invention that portion 215 may be formed from or include other materials. For example, portion 215 may be formed from a material that is non-elastomeric, but which is sufficiently deflectable to provide the above-described function of portion 215. Deflectable, non-elastomeric materials should have sufficient memory to repeatedly return the plug member to, or even urge the plug member beyond, its closed position. Illustrative examples of suitable non-elastomeric, deflectable materials include polypropylene and polyethylene. As shown, portion 215 takes the form of a ring or collar, but other shapes and configurations may be used so long as the resilient portion includes at least one, and preferably a plurality of, supports, ribs or other portions that interconnect the plug member and body 11 and bias the plug member into engagement with seal region 208. In the particular embodiment shown, portion 215 is formed with return valve assembly 70, but these portions may be separately formed. Biasing mechanism 212 may be molded via two-shot molding with plug member 206. However, it is also within the scope of the invention that these portions may be separately formed.

In the illustrated embodiment, portion 215 includes apertures 214 through which drink fluid may flow to reach valve assembly 16, such as shown on the right side of FIGS. 24 and 25. Accordingly, biasing mechanism 212 may alternatively be described as including a plurality of spaced-apart members, or supports, 217 between which drink fluid may flow and which interconnect the plug member with a portion of drink spout system 200 that does not move relative to the other portions when the drink spout system is used, such as flow restrictor 60 or other structure on base portion 14. Supports 217 may be formed from any of the above-discussed materials. Biasing mechanism 212 may be preloaded, similar to valve assemblies 16 and 70, using any suitable preload mechanism, such as those discussed herein. Preloading biasing mechanism 212 configures the biasing mechanism to be urged beyond the position in which it engages seal region 208, thereby forming a tighter seal.

Figure 26:
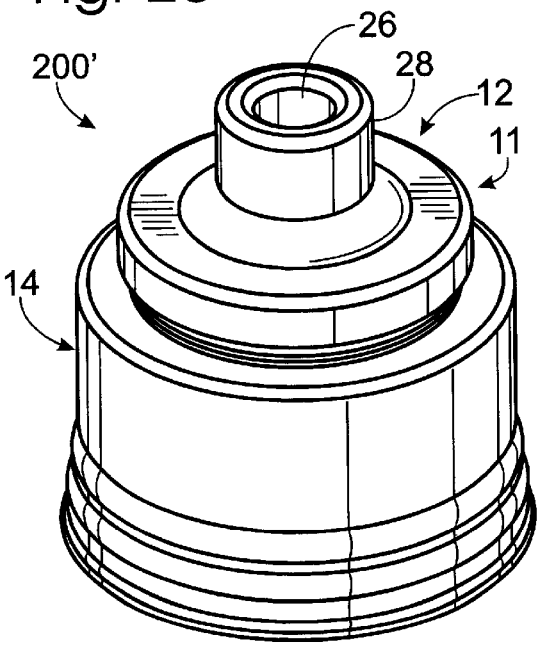
FIG. 26 is a top perspective view of another drink spout system constructed according to the present invention.
Figure 27:
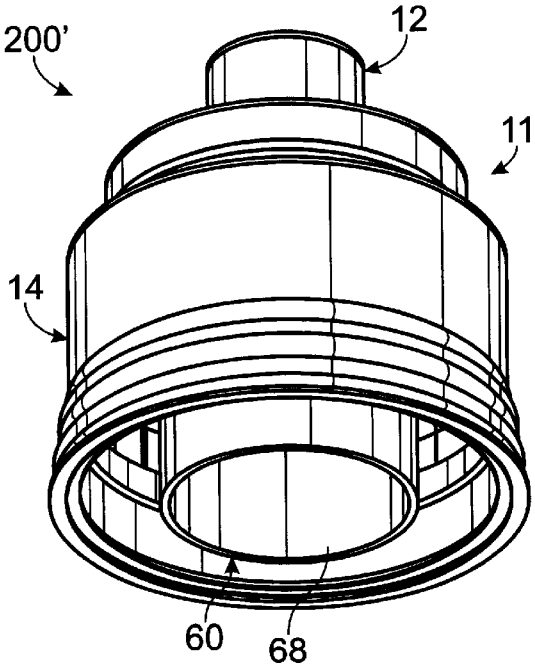
FIG. 27 is a bottom perspective view of the drink spout system of FIG. 26.
Figure 28:
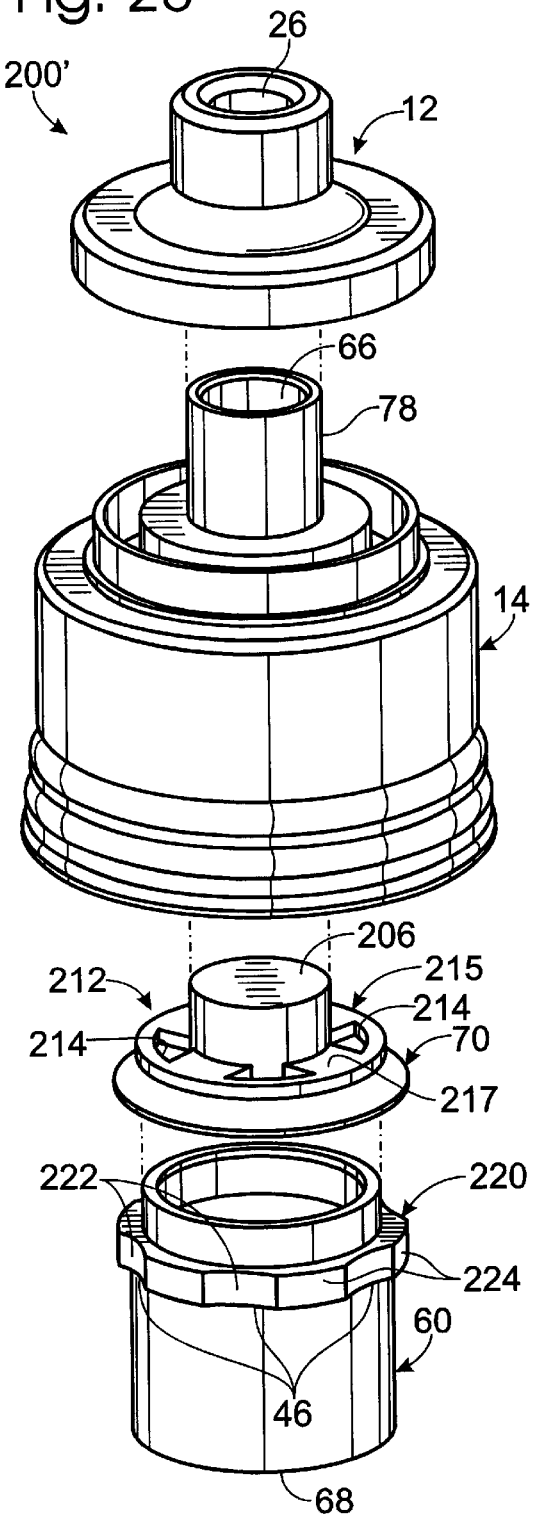
FIG. 28 is an exploded top perspective view of the drink spout system of FIG. 26.

In FIGS. 26–31, another embodiment of a drink spout system with a plug valve assembly 16 is shown and generally indicated at 200'. Unless otherwise indicated, system 200' may have the same components, subcomponents and variations as the other drink spout systems described herein. For example, as shown in FIGS. 26–28, system 200' includes a dispensing portion 12 with a mouthpiece 28 having an outlet 26, a base portion 14 on which the dispensing portion is mounted for slidable movement generally toward and away from the base portion, and a plug-type valve assembly 16 that is similar to the valve assembly described with respect to system 200.

Figure 29:
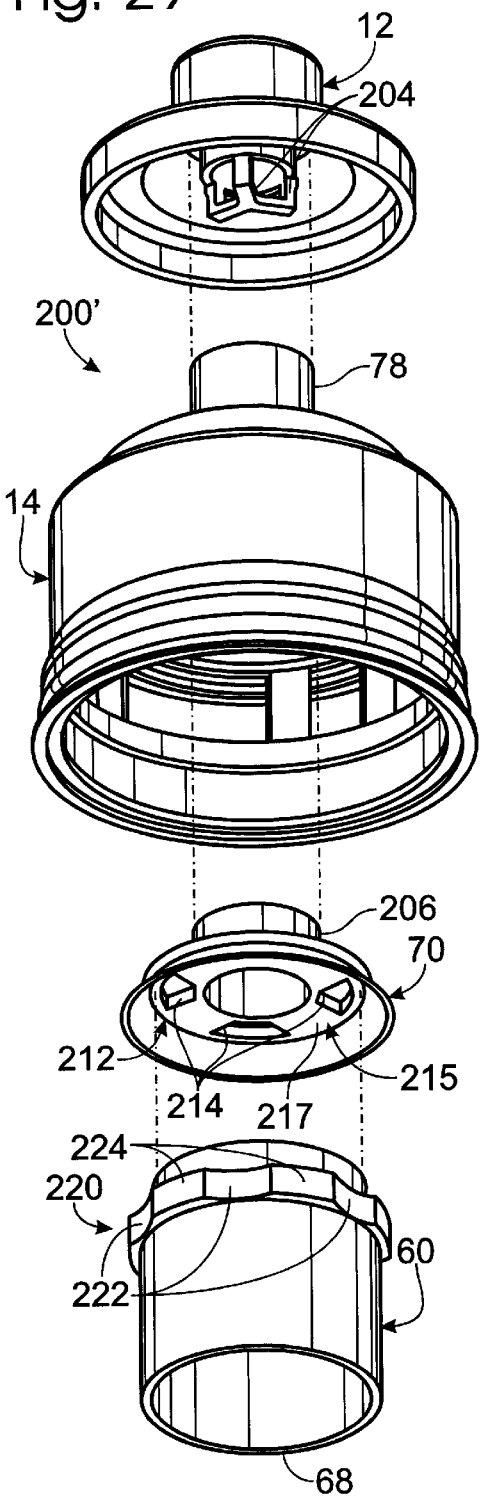
FIG. 29 is an exploded bottom perspective view of the drink spout system of FIG. 26.

In FIGS. 28–29, it can be seen that the illustrated embodiment of system 200' includes an air return system 40 with a return valve assembly 70 and a flow restrictor 60. As shown, return valve assembly 70 includes a collar 220 having radially spaced-apart recesses 222 and projections 224. Recesses 222 define flow paths through which air returned via air return system 40 may flow, and projections 224 provide mounts by which the flow restrictor may be secured to base portion 14, such as perhaps best seen in FIGS. 30 and 31. Similar to the previously described drink spout systems, it should be understood that system 200' may be formed without some or all of these elements, as well as with any of the variations to these elements described herein. For purposes of brevity, a discussion of these elements and their possible variations and alternate embodiments will not be repeated with respect to system 200'.

In operation, when user-applied forces are applied to dispensing portion 12, the dispensing portion slides toward base portion 14 along a track defined by guide portion 78. As the dispensing portion moves along this track, plug member 206 is urged away from sealing portion 208, thereby configuring plug valve assembly 16 to its dispensing position and defining an inlet 64 through which drink fluid may flow to be dispensed through outlet 26. When the user-applied forces are removed, biasing mechanism 212, such as portion 215, urges the plug member back into contact with seal region 208, thereby returning the plug valve assembly to its closed position, and in some embodiments urging the plug valve assembly beyond its closed position.

Figure 30:
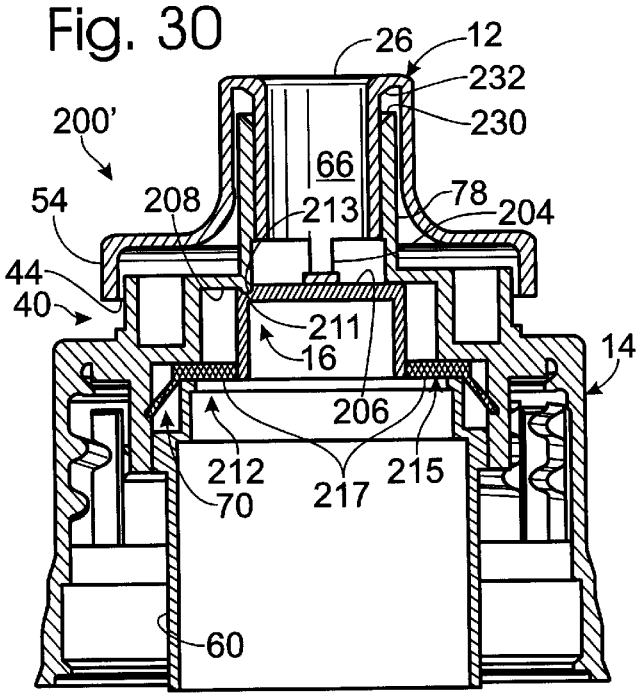
FIG. 30 is a cross-sectional view of the drink spout system of FIG. 26.
Figure 31:
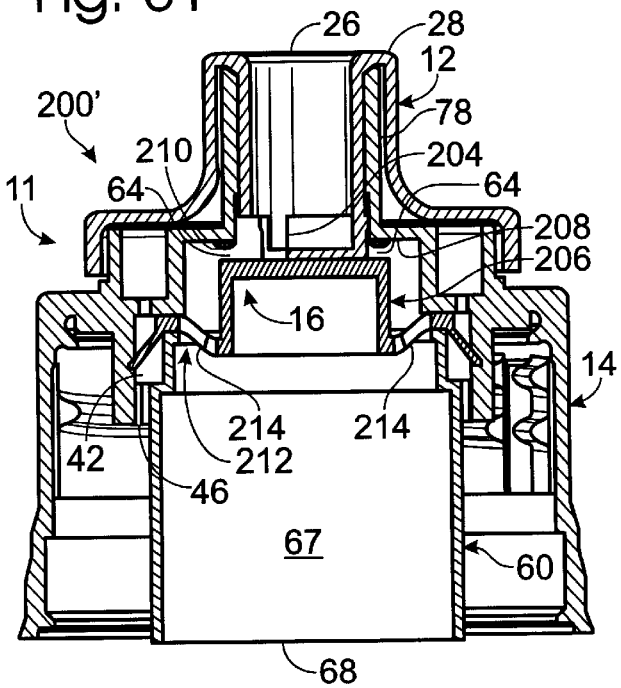
FIG. 31 is a cross-sectional view of the drink spout system of FIG. 26.

For purposes of illustration, FIG. 30 provides illustrative examples of plug valve assemblies 16 that are formed without seal member 210. For example, on the right side of FIG. 31, plug member 206 and sealing portion 208 have non-planar configurations. In the particular embodiment illustrated, sealing portion 208 includes a projecting member 211 and plug member 206 includes a recess 213 sized to receive at least a portion of member. On the left side of FIG. 30, plug member 206 and sealing portion 208 have generally planar configurations that abut each other to form a seal therebetween when the plug valve assembly is in its closed position. FIG. 31 provides an illustrative example of a plug valve assembly 16 in which the seal member is formed on seal region 208 instead of plug member 206.

Also shown in FIG. 30 is an alternative configuration for upper portion 230 of guide portion 78 and the corresponding inner surface 232 of dispensing portion 12. As shown, portion 230 and surface 232 extend at an angle to the direction of fluid flow through conduit 66. When the valve assembly is in its dispensing orientation, portion 230 engages surface 232 to provide a seal that prevents drink fluid and/or air from passing therethrough. When portions 12 and 78 are configured so that the dispensing portion may move laterally relative to guide portion 78, such as due to machining tolerances, orienting portion 230 and surface 232 at an upwardly or downwardly inclined angle provides for self-centering of the dispensing portion relative to the guide portion as portion 230 and surface 232 engage each other. It is within the scope of the invention that portion 230 and/or surface 232 may have other sealing configurations, such as those discussed with respect to plug member 206 and surface 208. It should be understood that it is also within the scope of the invention that portion 230 and surface 232 may be formed or sized so that they do not engage each other.

Figure 32:
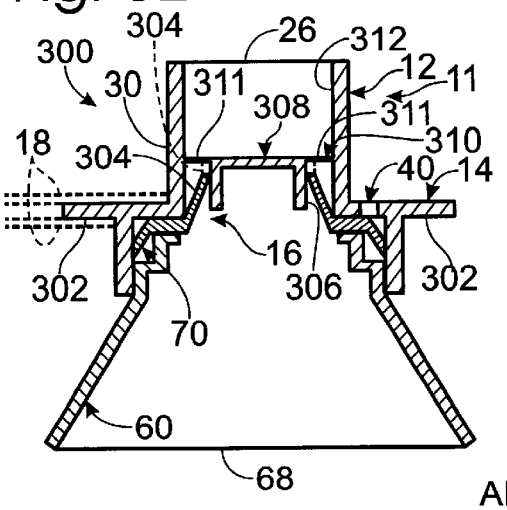
FIG. 32 is a cross-sectional view of another drink spout system constructed according to the present invention.
Figure 33:
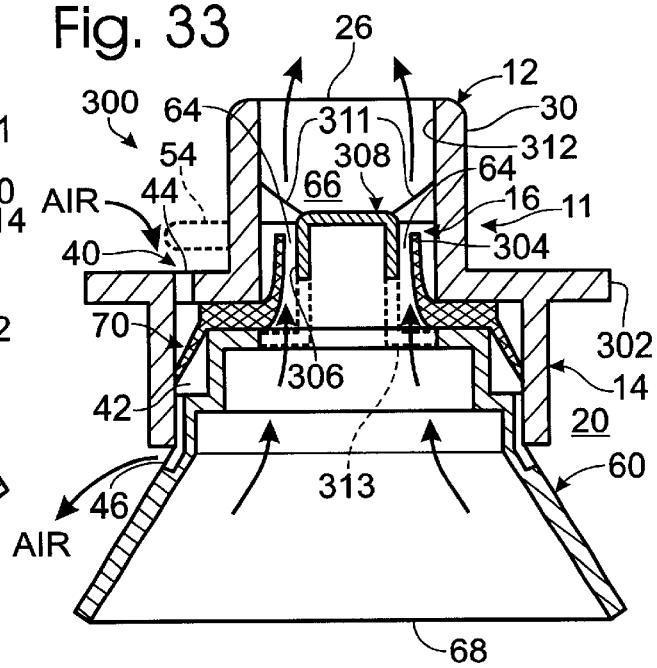
FIG. 33 is a cross-sectional view of a variation of the drink spout system of FIG. 32.

In FIGS. 32 and 33, another drink spout system constructed according to the present invention is shown and generally indicated at 300. Similar to the previously described embodiments, system 300 includes a dispensing portion 12, base portion 14 and valve assembly 16. In the illustrated embodiment, system 300 is shown including an air return system 40, a flow restrictor 60, and a return valve assembly 70. However, as discussed previously, it is within the scope of the invention that system 300 may be formed without some or all of the components, and that system 300 may include any of the variations and features described, illustrated and/or disclosed herein.

System 300 may be referred to as including a valve assembly 16 in the form of a "suction" valve assembly. By this it is meant that the valve assembly is actuated by a user-applied force that is adapted to draw drink fluid through the dispensing portion, as opposed to the user urging the dispensing portion toward the drink container with the user's mouth, such as disclosed in the previously described drink spout systems with plug valve assemblies 200 and 200'. An example of such a user-applied force is a user sucking on the dispensing portion. If the drink container is a collapsible container 18, such as a plastic drink bottle or collapsible drink box or drink pouch, the valve assembly shown in FIG. 32 may also be actuated by compressing, or collapsing, the container to urge drink fluid into engagement with the valve assembly with sufficient force to deflect the valve assembly to its dispensing position. Such a construction also enables drink fluid to be intentionally squirted from the drink spout system, such as to dispense drink fluid from a drink container without requiring a user's lips and mouth to touch the dispensing portion.

In dashed lines in FIG. 32, portions of a drink container 18 are shown extending above and below a flange 302 on base portion 14 to schematically illustrate that drink spout system 300 may be mounted on, under or laminated between portions of the drink container 18 with which the drink spout system is used. These configurations also illustrate examples of how base portion 14 may be adapted for use on drink containers that do not have a rigid neck. Accordingly, the drink spout systems disclosed herein that are shown with base portions 14 adapted to be received on a (threaded or unthreaded) neck may alternatively have a base portion similar to that shown in FIG. 32 or the other embodiments of base portion 14 illustrated herein that are not shaped to be received on a projecting neck, and vice versa. For example, in the subsequently discussed drink spout system shown in FIG. 34, base portion 14 is adapted to be received on a neck portion of a drink container. However, the ends of flange 302 have been indicated in dashed lines to demonstrate an alternate configuration for base portion 14, such as for use on a drink container that does not include a projecting neck.

An additional feature of a drink spout system with a valve assembly 16 in the form of a suction valve assembly is that the dispensing and base portions of the drink spout system do not need to move relative to each other. As such, the portions may be integrally formed, comolded (i.e. such as being formed by two-shot molding) or otherwise joined together to move as a unit. In some such embodiments, the drink spout system may be described as including a unitary body 11. Integrally forming these portions together should decrease the manufacturing and assembly costs of the drink spout system, although it is within the scope of the present invention that one or more of dispensing portion 12 and base portion 14 may have moveable or removable components, or that the portions may be releasably mounted to each other.

Similar to the previously discussed plug valve assembly, suction valve assembly 16 may (but is not necessarily) be formed without slits or otherwise free from slits, in that the valve assembly may include elastomeric member or membrane that does not have slits that enable drink fluid to flow through the member or membrane when the regions adjacent the slits are urged away from each other. In such an embodiment, the valve assembly is adapted to form a seal against another portion of the drink spout system, which typically is formed of a rigid, or non-elastomeric material. However, unlike the plug valve assembly, suction valve assembly 16 may be urged to its dispensing position without requiring pushing, tilting or other manipulation of the dispensing portion of the drink valve system.

As shown in FIG. 32, valve assembly 16 includes an internal perimeter portion 304 that extends and seals against the outer wall structure 306 of a core 308. It should be understood that core 308 and dispensing portion 12 may have a variety of configurations measured transverse to the direction of fluid flow, including configurations such as circles, ellipses, ovals and the like. As used herein, the term "wall structure" is used to refer to the sidewall, sidewalls or similar portions of various elements of the drink spout systems that extend generally parallel to the direction of fluid flow through the drink spout system. For example, wall structure 306 of core 308 may form a continuous expanse that does not include corners, or alternatively, may have a configuration that includes sidewalls separated by corners. For purposes of illustration, core 308 and dispensing portion 12 are shown having cylindrical configurations.

Core 308 is supported within fluid conduit 66 by one or more spaced-apart supports 310. Examples of suitable supports include ribs, vanes or the like that support the core relative to the dispensing portion while permitting drink fluid to flow past core 308 and be dispensed through outlet 26. Illustrative examples of suitable shapes for supports 310 are shown in FIGS. 32 and 33. However, supports 310 may have any suitable structure that supports core 308 for engagement by valve 16 while still permitting drink fluid to flow around the core when the valve is in its dispensing position. For example, in FIGS. 32 and 33, supports 310 are shown interconnecting the core with dispensing portion 12. It is within the scope of the invention, however, that supports 310 may interconnect and support the core with respect to other portions of body 11, such as base portion 14. An example of such a construction is shown in dashed lines in FIG. 33. It is within the scope of the invention that core 308 may be supported by one or more upper supports 311, which extend generally between the valve assembly and outlet 26, and/or one or more lower supports 313, which extend generally between the valve assembly and the drink container.

It is within the scope of the present invention that inner perimeter portion 304 may extend against outer wall structure 306 with only the interior edge of the perimeter portion engaging the outer wall structure of core 308. Alternatively, portion 304 may at least partially extend generally parallel to outer wall structure 306 in the region of contact to form a greater, or stronger, seal with the outer wall structure, such as shown in dashed lines in FIG. 32. In such an embodiment, the perimeter portion may be described as establishing a region of contact with the outer wall structure in which the interior edge of perimeter portion extends generally perpendicular to the outer wall structure, instead of extending generally parallel to the outer wall structure. A benefit of a surface of contact is that a stronger seal may be provided, compared to a valve assembly of similar construction but sized to form only a line of contact with outer wall structure 306. However, there is also a tradeoff between leak prevention and ease of use, in that the stronger the seal established by valve assembly 16, the greater force that must be applied to configure the valve assembly from its closed position to its dispensing position.

In the illustrated embodiment shown in FIG. 32, the suction valve assembly and return valve assembly 70 are integrally formed from an elastomeric material, such as thermoplastic elastomer or silicone. Each or both of these valve assemblies may be preloaded, as discussed herein, and it is within the scope of the invention that the valve assemblies may be separately formed. When the user sucks on the dispensing portion, which for purposes of illustration takes the form of a straw structure 30, perimeter portion 304 is urged at least partially away from core 308 and generally toward the interior walls, or wall structure, 312 of dispensing portion 12, such as shown in FIG. 33. As portion 304 is removed from contact from core 308, inlets 64 are formed through which drink fluid may flow past the core and be dispensed through outlet 26. In FIG. 32, perimeter portion 304 may be described as a sealing perimeter portion, in that the perimeter portion selectively seals against and is drawn at least partially away from against another portion of the drink spout system as the drink spout system is configured between its closed and dispensing positions.

Figure 34:
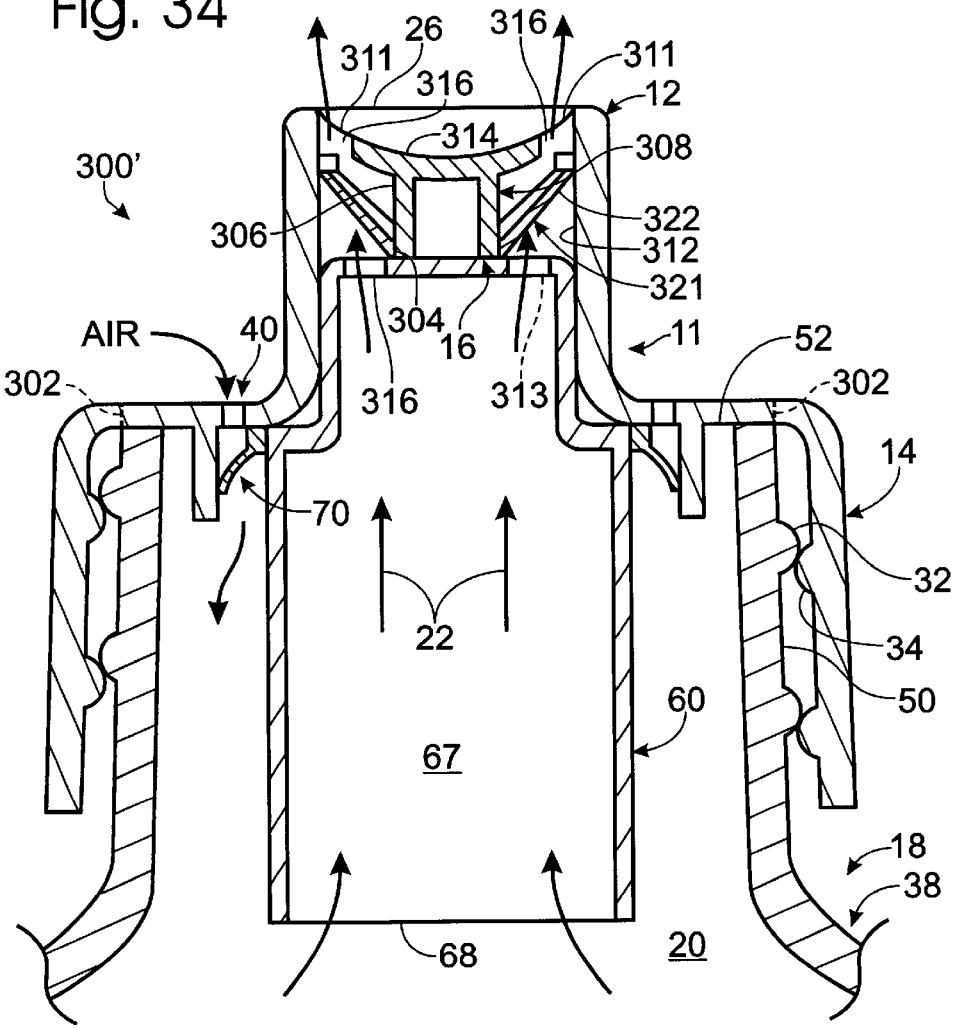
FIG. 34 is a cross-sectional view of another drink spout system constructed according to the present invention.
Figure 35:
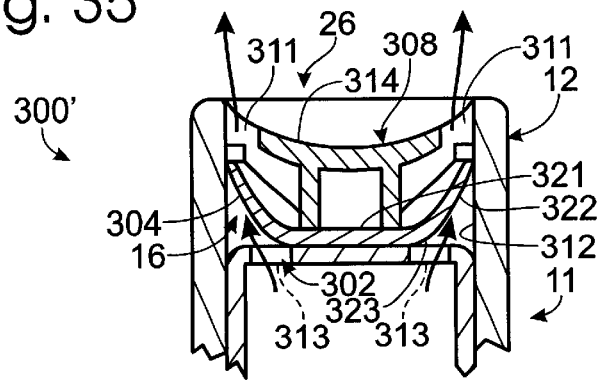
FIG. 35 is a fragmentary cross-sectional view of another variation of the drink spout system of FIG. 34.

Other examples of drink spout systems with a suction valve assembly 16 are shown in FIGS. 34 and 35 and generally indicated at 300'. Similar to the previously described embodiments, system 300' includes a dispensing portion 12, base portion 14 and valve assembly 16. In the illustrated embodiment, system 300' is shown including an air return system 40, a flow restrictor 60, and a return valve assembly 70. However, as discussed previously, it is within the scope of the invention that system 300' may be formed without some or all of the components, and that system 300' may include any of the variations and features described, illustrated and/or disclosed herein. For example, as discussed herein, drink spout systems that include both a valve assembly 16 and a return valve assembly 70 may have these valve assemblies separately formed or integrally formed. FIGS. 34 and 35 provide illustrative examples of drink spout systems in which valve assemblies 16 and 70 are separately formed.

In FIGS. 34 and 35, a further example of suitable core 308 and support 310 configurations is shown to illustrate that the core and supports may have a variety of suitable configurations. In the illustrated embodiment, upper and lower supports 311 and 313 are shown, with the upper and lower supports respectively including or being spaced-apart by apertures 316 through which drink fluid may flow. For example, in FIG. 34 core 308 includes a central portion 314 that forms a portion of outlet 26 along with upper supports 311 and apertures 316. In the embodiment shown in FIGS. 34 and 35, wall structure 306 of core 308 extends between the central, or internal perimeter, portion of valve assembly 16 and central portion 314 of the core. Similar to the previously described structure shown in FIGS. 32 and 33, at least one of the sets of supports 310 may optionally be omitted from the drink spout systems shown in FIGS. 34 and 35.

Central portion 314 and/or supports 311 reduce the space between suction valve assembly 16 and outlet 26 in which drink fluid may flow and not be dispensed through the outlet. In operation, it is possible that residual drink fluid may be retained in this space and thereafter unintentionally dispensed from the drink spout system. By reducing the size of the available space, the theoretical volume of drink fluid that may be contained therein is reduced. Similarly, the supports and central portion 314 provide surfaces that retain residual drink fluid via surface tension.

In FIG. 34, the valve assembly is illustrated as including a generally conically shaped member 321 that has an outer (or sealing) perimeter portion 322 that is larger than the corresponding inner diameter of dispensing portion 12 (or outer diameter of the fluid conduit), as defined by interior wall structure 312 of dispensing portion 12. The valve assembly may also be described as being generally concave relative to the outlet of the drink spout system and/or that the valve assembly has an outer perimeter portion 322 that extends closer to the outlet than the central portion of the valve assembly. Because perimeter portion 322 extends generally toward outlet 26, it already extends at least partially in the direction the valve assembly will need to deform when the valve assembly is in its dispensing position, as opposed to a flat diaphragm valve, which extends completely transverse to the direction of fluid flow.

In FIG. 34, the valve assembly includes an inner perimeter portion 304, which extends around outer wall structure 306 of core 308. As such, the valve assembly may be described as having a central aperture and as forming an annular ring or skirt of elastomeric material. However, this central aperture is not required, such as shown in FIG. 35 in which the valve assembly extends under core 308 and does not include a central aperture. Similar to the inner perimeter portion discussed above with respect to FIG. 32, the outer perimeter portion of the valve assembly shown in FIGS. 34 and 35 may engage interior wall structure 312, either with only its outer edge, or it may extend at least partially against and generally parallel to wall structure 312 to provide a region of overlapping contact.

The extent to which outer perimeter portion 322 is drawn away from interior wall structure 312 will vary in part upon the amount of user-applied force imparted to the valve assembly. For example, generally the harder a user sucks on the dispensing portion, the more portion 322 will be drawn away from interior wall structure 312, and therefore the larger the inlet 64 through which drink fluid may flow into fluid conduit 66. Therefore, having a very flimsy valve will enable a relatively large flow rate of fluid with a correspondingly low amount of suction or other force that must be applied. However, there is a tradeoff between ease of use and spill resistance, because it is the strength with which the valve assembly is urged toward or beyond its closed position that to a large extent defines the strength of the seal formed by the valve assembly. Therefore, having a very strong seal, such as by having a comparatively thick valve assembly, or a valve assembly formed from a stiffer material, will form a tighter seal, but require a user to exert more force to dispense drink fluid through the drink spout system.

The amount of force required to draw the valve assembly away from its closed position typically may be reduced by such factors as using a thinner valve assembly or a valve assembly in which portions of the valve assembly have been thinned, a valve assembly formed from a less stiff material, changing the angular orientation of the valve assembly relative to outlet 26, sizing the valve assembly so that it has a smaller surface of contact with the wall structure with which it forms a seal, and reducing the amount of preload on the valve assembly. Correspondingly, the amount of force required to draw the valve assembly away from its closed position typically may be increased by such factors as thickening the valve assembly, or at least portions thereof, forming the valve assembly from stiffer material, and changing the orientation of the valve assembly relative to direction of fluid flow (as discussed in more detail herein).

As shown in FIGS. 34 and 35, the outer perimeter portion of the valve assembly extends at an angle with respect to the surface against which it extends, such as interior wall structure 312. More particularly, portion 322 is shown extending at an angle of approximately 45°. It should be understood that other angles may be used, such as angles in the range of 0° (such as with a diaphragm valve) and 75°. For many valve constructions angles in the range of 15–75° may provide a desirable combination of ease of use and spill prevention, with angles in the range of 30–60° or angles of 45° or approximately 45° being preferred.

In FIG. 34, the valve assembly generally tapers as it extends outwardly, with the outer perimeter portion being thinner than the central portion of the valve assembly. It is within the scope of the invention, however, that the valve assembly may have a constant thickness or that the outer perimeter portion may be thicker or thinner than the central portion. For example, the outer perimeter portion may have a rib or reinforcing ring of greater thickness than the rest of the valve assembly to provide a stronger seal without thickening the entire valve assembly. An example of such a rib or region of increased thickness is shown in dashed lines at 336 on the left side of the valve assembly shown in FIG. 37.

Figure 36:
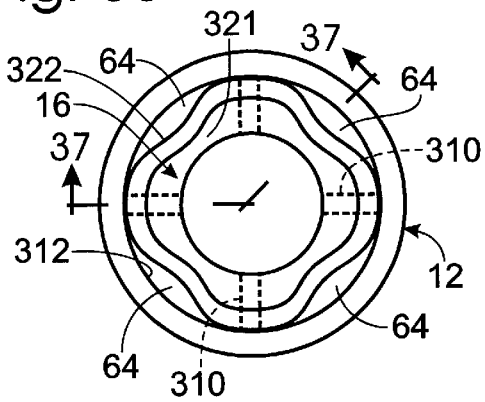
FIG. 36 is a top plan view of the dispensing portion and valve assembly of a variation of the drink spout systems shown in FIGS. 34 and 35.

If the suction valve assembly is not sufficiently resilient, it may be drawn into a position in which it may not return to the closed position when user-applied forces are removed. For example, if the deflected perimeter portion of the valve assembly folds or creases upon itself or rests against a portion of the drink spout system radially inward or outward from the sidewall against which it rests in the closed position, there is a possibility that the valve assembly may not return to the closed position. Therefore, it is preferable that suction valve assemblies according to the present invention are constructed so that they can extend to or beyond an over-centered position, but not to a bistable position. As used herein, an over-centered position is meant to refer to a position in which a region of the sealing perimeter portion of the valve assembly transitions from a generally concave configuration to a convex configuration, when viewed from the outlet of the drink spout system, such as shown in FIG. 36. As used herein, bistable is meant to refer to when the valve assembly reaches a stable position other than its closed position, or a position in which the valve assembly will remain, even after the user-applied forces that urged the valve assembly from its closed position are removed. Should such a positioning of the valve assembly be reached, it follows that the valve assembly would not return to the closed position, and therefore would not seal upon removal of the user-applied forces.

Figure 37:
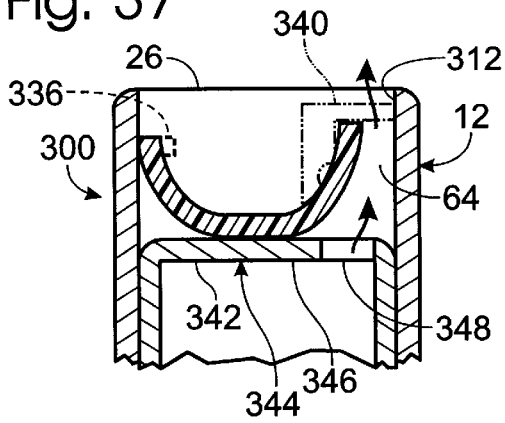
FIG. 37 is a cross-sectional view of the dispensing portion and valve assembly shown in FIG. 36, taken along the line 37—37 in FIG. 36.

For purposes of illustration, consider the suction valve assembly shown in FIG. 34. When a user sucks on dispensing portion 12 or collapses the drink container on which the drink spout system is mounted, perimeter portion 322 of suction valve assembly 16 is urged at least partially away from interior wall structure 312, such as shown in FIG. 36 and on the right side of FIG. 37. When this occurs, inlet 64 is formed between the valve assembly and interior wall structure 312, and drink fluid may be dispensed through the drink spout system. In FIG. 37, perimeter portion 322 is shown in an over-centered position and the perimeter portion extends generally parallel to the direction of fluid flow.

To prevent the perimeter portion from being drawn too far away from interior wall structure 312, such as to a bistable position, and/or to prevent the perimeter portion from extending to a position where it may be more likely to fold upon itself, the drink spout system may be configured to limit the extent to which the perimeter portion of the valve assembly may deflect away from its closed position and/or to shape the valve assembly as it extends away from its closed position. For example, the drink spout system may include a guide 340 that accomplishes either or both of these objectives by providing a surface against which the valve assembly may at least partially or completely extend and which defines the maximum deflection of the valve assembly. An example of such a guide 340 is schematically illustrated in dashed lines on the right side of the drink spout system shown in FIG. 37. Guide 340 may extend or be mounted on any suitable portion of the drink spout system, such as core 308, dispensing portion 12, upper supports 311, etc. As shown, guide 340 is shaped to provide spaced-apart regions of contact with valve assembly 16, but it is also within the scope of the present invention that the guide may form a smooth or continuous surface of contact along the valve assembly.

In FIG. 36, suction valve assembly 16 is shown being drawn away from interior wall structure 312 in four locations to form four inlets 64. The number and size of inlets 64 may be defined in part by upper and/or lower supports 311 and 313. Because drink fluid passes between apertures 316 that are either formed within or extend between the upper or the lower supports, the size and spacing of the supports may be used to at least partially define the number and size of inlets 64. For example, lower supports 313 may be used to define the primary regions of the underside of sealing perimeter portion 304 that drink fluid strikes when user-imparted forces urge the drink fluid into contact with the valve assembly, such as when the drink container is at least partially collapsed. Drink fluid that is drawn from container 18 toward the valve assembly is drawn through apertures 316 extending between supports 313, and thereby is at least partially segregated into discrete flows. In these positions where the flow of drink fluid is concentrated, the sealing perimeter portion of the valve assembly is more likely to be drawn away from interior wall structure 312 to form an inlet 64 through which the drink fluid may flow. As another example, upper supports 311 define the flow paths for drink fluid between inlet(s) 64 and outlet 26. Because the drink fluid will follow the path of least resistance between the inlet(s) and outlet, the flow path of the fluid will at least partially define the region wherein the sealing perimeter portion is drawn away form interior wall structure 312. Both of these examples may be described as providing an indirect control of the size and number of the inlets because the sealing perimeter portion of the valve assembly does not directly engage the supports.

By varying the number and size of the supports, the size and number of inlets may be at least partially defined. In FIG. 36, four supports are schematically illustrated and generally indicated at 310, but size and the number of supports may vary. Typically, at least two or three upper or lower supports will be used, but more than four may also be used. A benefit of having defined flow paths is that it reduces the likelihood of the valve assembly folding upon itself, especially if the drink spout system does not include a core 308 internal the valve assembly. It is within the scope of the invention that suction valve assembly 16 may be used in drink spout systems that do not include flow-directing supports. Similarly, suction valve assemblies in which the inner perimeter portion deflects away from outer wall structure 306 of core 308 may also include either or both of the above-described supports or vanes.

Additionally, or alternatively, the supports may directly control the size and number of inlets formed by the sealing perimeter portion of the valve assembly. For example, if lower supports 313 are bonded or otherwise secured to valve assembly 16, this bond may limit the regions of the sealing perimeter portion that are drawn, or at least initially drawn, away from internal wall structure 312. Similarly, upper supports 311 may be positioned to that the sealing perimeter portion of the valve assembly engages the supports as the portion is drawn away from structure 312. For example, supports 311 may include guides 340.

It should be understood that the above-described flow-regulating function of supports 311 and 313 may additionally or alternatively be accomplished using structures that do not support core 308. In such an embodiment, supports 311 and 313 may be referred to as vanes or vane assemblies. Similarly, these supports or vanes may be referred to as flow-regulating structures or devices or flow-directing structures or devices, in that they are configured to at least partially, substantially or completely define the path of the drink fluid through the drink spout system and/or the configuration of the valve assembly as it is urged away from its closed position.

It should be understood that the above discussion of the design of valve assembly 16 and outer perimeter portion 322, supports or vanes, and guides 340 may also be applied to suction valve assemblies, such as those shown in FIGS. 32 and 33, having a deflectable inner perimeter portion 304 that forms a seal against outer wall structure 306 of core 308. Similarly, it is within the scope of the invention that the flow-regulating structures, such as the supports and/or vanes described above, may be used with other drink spout systems, such as those described, illustrated and/or incorporated herein.

A distinction between the suction valve assemblies shown in FIGS. 32 and 33 with the valve assemblies shown in FIGS. 34 and 35 is whether the sealing perimeter portions of valve assemblies are compressed or expanded when the valve assembly is in its dispensing position. In the embodiment shown in FIGS. 32 and 33, the suction valve assembly includes a ring of elastomeric material that has an inner perimeter portion 304 that selectively seals against the rigid construction of core 308. When the suction valve assembly is in its closed position, such as shown in FIG. 32, the inner perimeter portion of the ring is at its smallest available diameter and is sealed against outer wall structure 306 of core 308. As a user sucks on the dispensing portion, the valve assembly is drawn away from the outer wall structure, such as shown in FIG. 33. This results in the inner perimeter portion being at least partially stretched or expanded.

In comparison, the suction valve assembly shown in FIGS. 34 and 35 have outer perimeter portions 322 that selectively engage and seal against interior wall structure 312 of dispensing portion 12 when the valve assembly is in its closed position. When the valve assembly is urged to its dispensing position, portions 322 are at least partially drawn away from wall structure 312, thereby compressing at least a portion of the sealing perimeter portion of the valve assembly. Although both of these embodiments are within the scope of the present invention, at least partially compressing the sealing perimeter portion of the valve assembly requires comparatively less force to maintain or increase the size of inlets 64 after the sealing perimeter portion is withdrawn from engagement with the corresponding wall structure. Expressed another way, the valve assembly shown in FIGS. 34 and 35 creates a larger inlet, or opening through which the drink fluid may pass through the valve assembly, compared to a similarly constructed valve assembly shown in FIGS. 32 and 33 when an equal force is applied to the valve assemblies.

A benefit of a suction valve assembly that has a generally concave, or U-shaped configuration relative to outlet 26 is that the force required to maintain the valve assembly in its dispensing position or to increase the size of inlet(s) 64 (thereby increasing the potential flow rate) generally levels off or even decreases after the valve assembly is initially configured from its closed position to its dispensing position. Therefore, the valve requires more force to initially be configured to its dispensing position, but thereafter defines a range of dispensing positions in which less force is required to prevent the valve assembly from returning to its closed position. For many applications, such a valve assembly may provide a preferred mix of spill-resistance and ease of use. In comparison, diaphragm, or pancake, valve assemblies, in which the valve assembly extends transverse to the direction of fluid flow in its closed position, as well as valve assemblies similar to those shown in FIGS. 32 and 33, require at least a constant, if not an increasing amount of force to configure the valve assembly to its dispensing configuration and to maintain the valve assembly in its dispensing position or to increase the size of inlet(s) 64.

Figure 38:
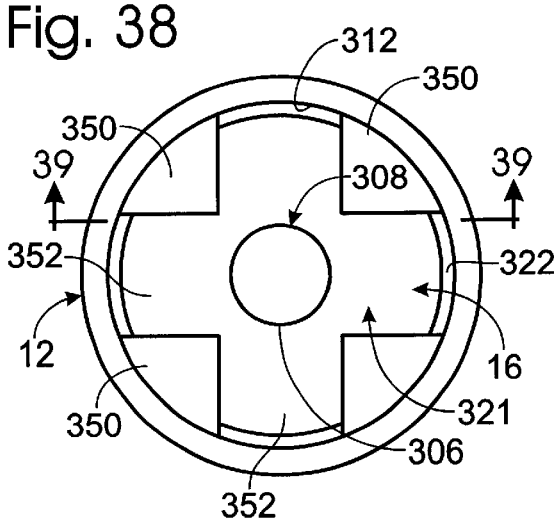
FIG. 38 is a top plan view of another dispensing portion and valve assembly constructed according to the present invention.
Figure 39:
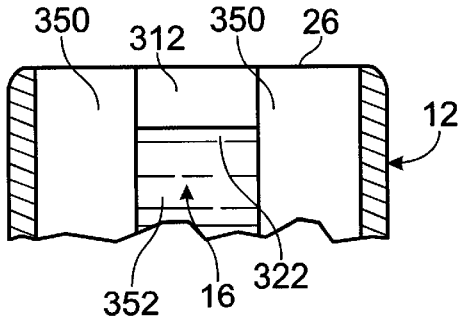
FIG. 39 is a cross-sectional view of the dispensing portion and valve assembly of FIG. 38 taken along the line 39—39 in FIG. 38.

Although described above as having a disc-like or generally conical structure, it should be understood that suction valve assembly 16 may include flaps or other deflectable members and may have a non-symmetrical shape. For example, dispensing portion 12 may have a configuration that includes internal corners or projections. An example of such a configuration is shown in FIGS. 38 and 39. As shown, dispensing portion 12 includes corners 350 and valve assembly 16 includes radially spaced-apart flaps 352 having deflectable outer perimeter portions 322.

In FIGS. 40–44, another drink spout system constructed according to the present invention is shown and generally indicated at 400. Similar to the previously described embodiments, system 400 includes a dispensing portion 12, base portion 14 and valve assembly 16 in the form of a suction valve assembly 16. In the illustrated embodiment, system 400 is shown including an air return system 40, a flow restrictor 60, and a return valve assembly 70. However, as discussed previously, it should be understood that system 400 may be formed without some or all of the components, and that system 400 may include any of the variations and features described, illustrated and/or disclosed herein. System 400 provides another illustrative example of a drink spout system that includes a valve assembly 16 that is adapted to be actuated by a user sucking on the dispensing portion of the drink spout system or squeezing the drink container on which the system is mounted.

Figure 40:
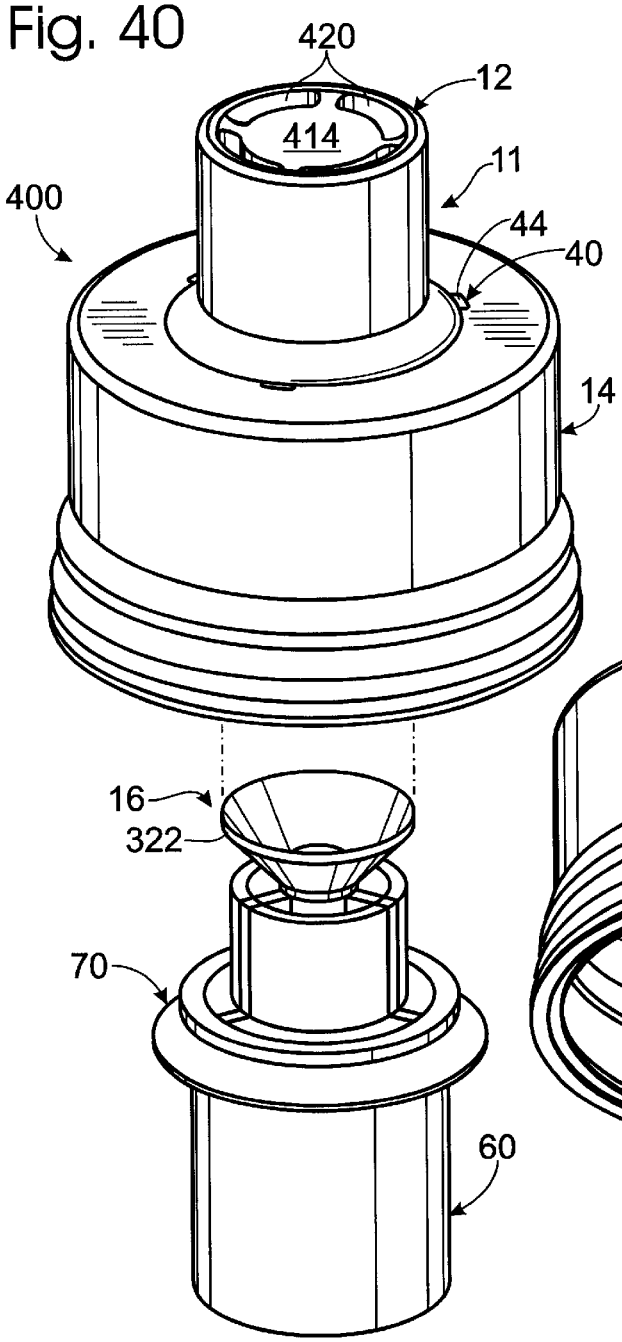
FIG. 40 is an exploded top perspective view of another embodiment of a drink spout system constructed according to the present invention.
Figure 41:
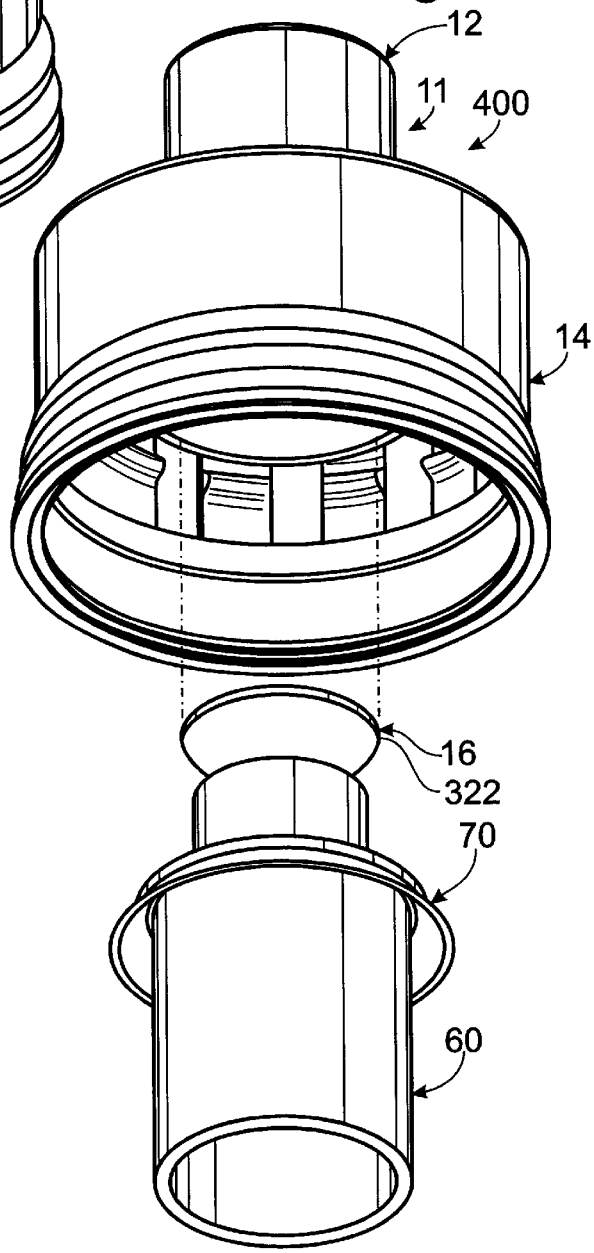
FIG. 41 is an exploded bottom perspective view of the drink spout system of FIG. 40.
Figure 42:
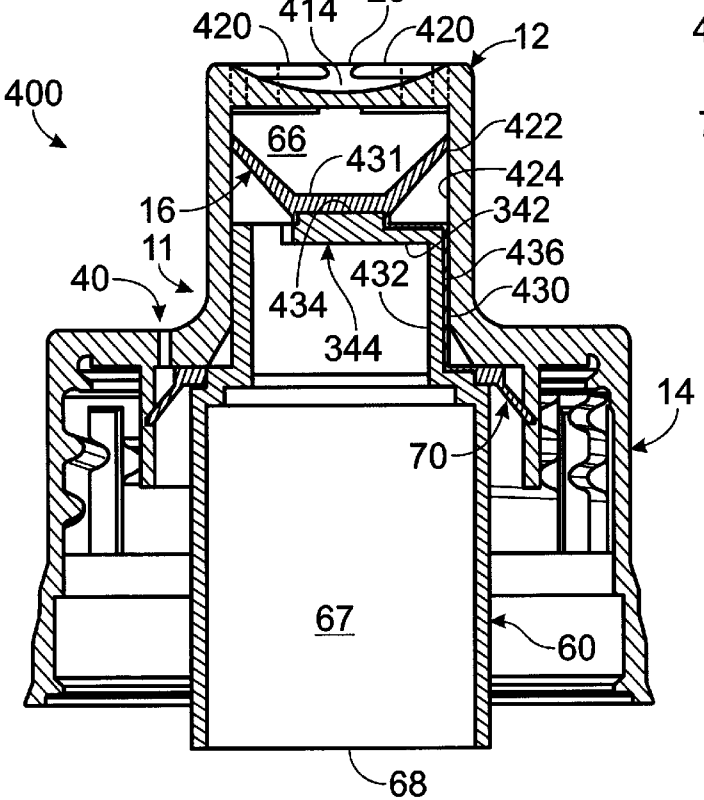
FIG. 42 is a cross-sectional view of the drink spout system of FIG. 40.

As shown in FIGS. 40 and 42, dispensing portion 12 includes an outlet 26 with a central portion 414 and a plurality of radial apertures 420 through which drink fluid may flow to be dispensed from the drink spout system. It should be understood that other outlet configurations may be used, such as having a single central aperture in portion 414. In such an embodiment, the central aperture may be radially inward from sidewall 424, or alternatively may have the same or at least substantially the same diameter (or cross-sectional area, depending on the particular shape of dispensing portion 12) as the dispensing portion measured between interior wall structure 424. Illustrative examples of these configurations are demarcated with dashed lines in FIG. 42, and it should be understood that the same or similar configurations may be used with other drink spout systems according to the present invention.

As shown in FIG. 42, valve assembly 16 includes an outer perimeter portion 422 that selectively seals against interior wall structure 424 of dispensing portion 12 when the valve assembly is in its closed position. When a user sucks upon dispensing portion 12 or at least partially collapses the drink container on which system 400 is mounted, the portion 422 is drawn away from wall structure 424, thereby defining an inlet to a fluid conduit 66 through which drink fluid may flow to outlet 26.

Figure 44:
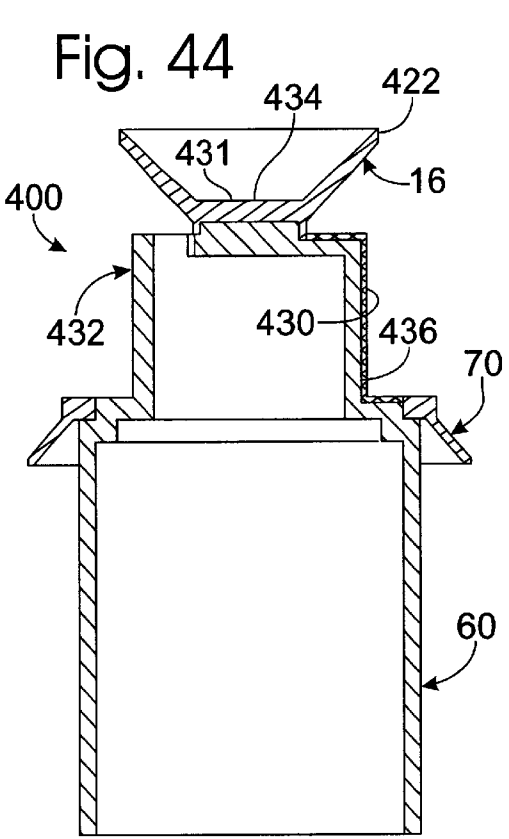
FIG. 44 is a cross-sectional view of the valve assembly and flow restrictor shown in FIG. 43.
Figure 43:
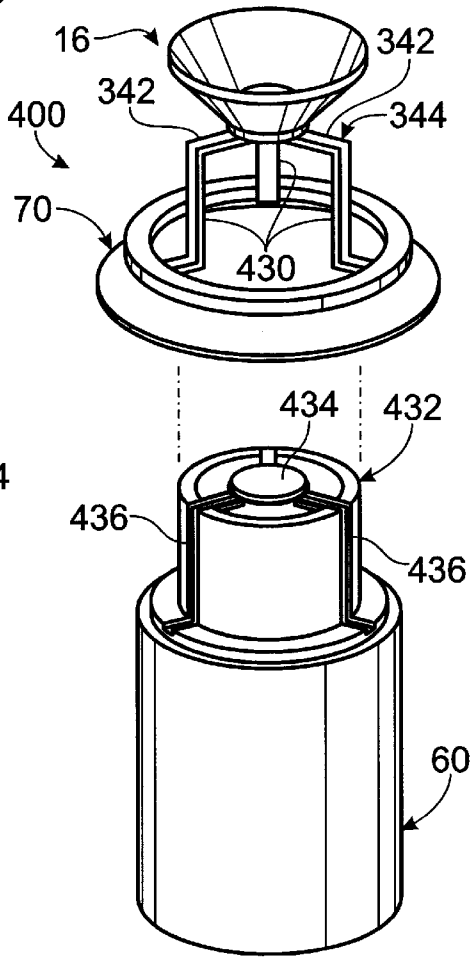
FIG. 43 is an exploded view of the valve assembly and flow restrictor of the drink spout system of FIG. 40.

As perhaps best seen in the illustrative embodiment shown in FIGS. 42–44, valve assembly 16 is interconnected with return valve assembly 70 by a plurality of supports 430. As shown in FIG. 43, flow restrictor 60 includes an upper sleeve 432 that includes a mount 434 on which central portion 431 of valve assembly 16 is secured. Sleeve 432 also defines channels 436 into which supports 430 are received to position and support the valve assemblies relative to the flow restrictor and the rest of the drink spout system. Although other manufacturing methods may be used, including separate formation and subsequent assembly of these portions, it is within the scope of the invention that valve assembly 16, supports 430, and return valve assembly 70 are all molded together. As such, these portions may be installed as a unit with the rest of the drink spout system. The drink spout system shown in FIGS. 42–44 also demonstrates another example of a vane assembly 344, which as shown includes three vanes extending beneath the valve assembly.

In many of the drink spout systems shown, described and incorporated herein, the systems include valve assemblies that are formed from an elastomeric material and are biased to selectively engage and release from another portion of the drink spout system, which in many embodiments is formed from a different material, such as polypropylene or another relatively hard plastic. Although such a construction is not required, it provides an advantage in that thermoplastic elastomers tend to stick together or to themselves, which can impair the operation of the valve assembly. Although other suitable elastomeric materials may be used, such as silicone, thermoplastic elastomers are less expensive from materials and manufacturing standpoints compared to silicone and similar materials that do not stick to together or to themselves.

INDUSTRIAL APPLICABILITY

The invented drink spout systems are applicable in the drink packaging and other liquid packaging industries, and are specifically applicable to drink containers such as drink bottles and aseptic drink pouches, boxes and bottles.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A drink spout system, comprising:

a body having a base portion adapted to be coupled to a drink container having a compartment adapted to contain drink fluid and a dispensing portion coupled to the base portion and selectively movable relative thereto, wherein the dispensing portion includes an outlet through which drink fluid passes as it is dispensed from the drink spout system, and further wherein the dispensing portion defines at least a portion of a fluid conduit through which drink fluid flows through the drink spout system to the outlet;

a valve assembly adapted to selectively permit drink fluid to flow through the fluid conduit to the outlet, wherein the valve assembly is selectively configurable between a dispensing position, in which drink fluid may flow through the fluid conduit to the outlet, and a closed position, in which the valve assembly prevents drink fluid from passing through the fluid conduit to the outlet, wherein the dispensing portion is adapted to urge the valve assembly to its dispensing position as the dispensing portion is moved in a direction generally toward the valve assembly; and an air return system adapted to permit air from external the compartment to enter the compartment as drink fluid is dispensed from the outlet, wherein the air return system includes at least one air return inlet on the body through which air from external the drink container may be drawn as drink fluid is dispensed through the drink spout system, at least one air return outlet in fluid communication with the at least one air return inlet and adapted to deliver the air into the compartment as drink fluid is dispensed through the drink spout system, and at least one air passage interconnecting the at least one air return inlet and the at least one air return outlet, wherein the air return system further includes a return valve assembly that is selectively configurable between an open position, in which air may pass through the at least one air passage and into the compartment, and a closed position, in which the return valve assembly obstructs the at least one air passage so that air may not pass through the at least one air passage and into the compartment, and further wherein the return valve assembly is adapted to automatically return to the closed position.

2. The system of claim 1, wherein the dispensing portion is slidably mounted on the base portion.

3. The system of claim 1, wherein the valve assembly is adapted to automatically return to the closed position.

4. The system of claim 3, wherein the valve assembly is at least partially formed from an elastomeric material.

5. The system of claim 3, wherein the drink spout system further includes a preload mechanism adapted to urge the valve assembly beyond its closed position.

6. The system of claim 1, wherein the valve assembly includes at least one slit through which drink fluid may flow when the valve assembly is in its dispensing position.

7. The system of claim 1, wherein the valve assembly is free from slits through which drink fluid may flow when the valve assembly is in its dispensing position.

8. The system of claim 1, wherein the valve assembly is formed from a non-elastomeric material.

9. The system of claim 1, wherein the body includes a cover adapted to prevent at least a portion of the at least one air return inlet from being obstructed when a user drinks from the drink spout system.

10. The system of claim 1, wherein the body includes means for preventing the at least one air return inlet from being obstructed when a user drinks from the drink spout system.

11. The system of claim 1, wherein the air return system includes a plurality of air return inlets into which air from external the container may enter an air passage, and a plurality of air return outlets through which the air enters the compartment.

12. The system of claim 11, wherein the air return inlets are radially spaced around the fluid conduit.

13. The system of claim 1, wherein the body includes a sidewall through which air may enter at least one of the air return inlets.

14. The system of claim 1, wherein the return valve assembly is at least substantially formed from an elastomeric material.

15. The system of claim 14, wherein the return valve assembly has an outer perimeter portion that extends generally away from the outlet through which drink fluid is dispensed from the drink spout system.

16. The system of claim 14, wherein the return valve assembly and the valve assembly are at least substantially formed from an elastomeric material.

17. The system of claim 16, wherein the return valve assembly and the valve assembly are integrally formed.

18. The system of claim 17, wherein the return valve assembly and the valve assembly are generally concentrically oriented relative to each other, with the return valve assembly extending radially outward relative to the valve assembly.

19. The system of claim 1, wherein the return valve assembly is integrally formed with the valve assembly.

20. The system of claim 1, wherein the return valve assembly and the valve assembly are free from slits.

21. The system of claim 1, wherein the return valve assembly is a pressure-differential valve assembly.

22. The system of claim 1, wherein the drink spout system further includes means for restricting air returned to the compartment from being drawn into the valve assembly as air bubbles.

23. The system of claim 1, wherein the drink spout system further includes direction independent means for restricting air returned to the compartment from being drawn into the valve assembly as air bubbles.

24. The system of claim 1, wherein the drink spout system further includes a flow restrictor adapted to prevent the air entering the compartment through the air return system from being drawn as air bubbles into the fluid conduit as drink fluid is dispensed from the drink container.

25. The system of claim 24, wherein the flow restrictor is adapted to prevent the air entering the compartment through the air return system from being drawn into the fluid conduit as drink fluid is dispensed from the drink container regardless of the orientation of the drink container.

26. The system of claim 24, wherein the flow restrictor includes a partition extending into the compartment to at least substantially separate the compartment into a region generally beneath the air return system and a region generally beneath the valve assembly.

27. The system of claim 24, wherein the flow restrictor includes a sleeve surrounding the valve assembly and extending into the compartment.

28. The system of claim 27, wherein the flow restrictor includes at least one flange extending outward from the sleeve.

29. The system of claim 24, wherein the flow restrictor includes a sleeve surrounding the at least one air return outlet and extending into the compartment.

30. The system of claim 1, wherein the body further includes a lock mechanism that is selectively configurable between a locked position, in which the valve assembly is prevented from being urged from its closed position to its dispensing position, and an unlocked position, in which the valve assembly may be configured to its dispensing position as the dispensing portion is moved generally toward the valve assembly.

31. The system of claim 30, wherein the lock mechanism is adapted to prevent the dispensing portion from configuring the valve assembly to its dispensing position when the lock mechanism is in its locked position.

32. The system of claim 30, wherein the lock mechanism is adapted to be selectively configured between its locked and unlocked positions upon rotation of the dispensing portion relative to the base portion.

33. The system of claim 1, in combination with a drink container having an internal compartment adapted to contain drink fluid and an opening over which the drink spout system is mounted.

34. The system of claim 33, wherein the drink container is an aseptic drink container and the compartment contains drink fluid.

35. The system of claim 33, wherein the base portion is adapted to be repeatedly coupled to and removed from the drink container.

36. The system of claim 33, wherein the drink container is a drink bottle having a neck with an opening and a reduced cross-sectional area compared to at least a substantial portion of the drink container, wherein the neck has a diameter of less then 6 centimeters, and further wherein the base portion of the drink spout system is mounted on the neck so that drink fluid passing through the opening is received into the drink spout system.

37. The system of claim 36, wherein the neck has a diameter that is less than 4 centimeters.

38. The system of claim 36, further including an air return system adapted to deliver air from external the compartment into the compartment through a passage other than the fluid conduit.

39. The system of claim 38, wherein the air return system further includes a return valve assembly that is selectively configurable between an open position, in which air may pass through the passage and into the compartment, and a closed position, in which the return valve assembly obstructs the flow of air so that air may not pass through the passage and into the compartment.

40. The system of claim 38, wherein the drink spout system further includes a flow restrictor adapted to restrict the air entering the compartment through the air return system from being drawn into the fluid conduit as drink fluid is dispensed from the drink container.

41. The system of claim 40, wherein the flow restrictor is adapted to restrict the air entering the compartment through the air return system from being drawn into the fluid conduit as drink fluid is dispensed from the drink container regardless of the orientation of the drink container.

42. The system of claim 40, wherein the drink spout system further includes means for restricting air returned to the compartment from being drawn into the valve assembly as air bubbles.

43. A drink spout system, comprising:

a body having a base portion adapted to be coupled to a drink container having a compartment adapted to contain drink fluid and a dispensing portion coupled to the base portion and selectively movable relative thereto, wherein the body includes a seal region, wherein the dispensing portion includes a contactor, wherein the dispensing portion includes an outlet through which drink fluid passes as it is dispensed from the drink spout system, and further wherein the dispensing portion defines at least a portion of a fluid conduit through which drink fluid flows through the drink spout system to the outlet; and a valve assembly adapted to selectively permit drink fluid to flow through the fluid conduit to the outlet, wherein the valve assembly is selectively configurable between a dispensing position, in which drink fluid may flow through the fluid conduit to the outlet, and a closed position, in which the valve assembly prevents drink fluid from passing through the fluid conduit to the outlet, wherein the dispensing portion is adapted to urge the valve assembly to its dispensing position as the dispensing portion is moved generally toward the valve assembly, wherein the valve assembly includes a plug member that in the closed position engages the seal region to prevent drink fluid from flowing into and through the fluid conduit to the outlet, wherein in the dispensing position the plug member is urged away from the seal region to define an inlet to the fluid conduit through which the drink fluid may flow through the valve assembly, wherein the plug member is adapted to be urged away from the seal region by the contactor when the dispensing portion is moved in a direction generally toward the valve assembly, wherein the valve assembly further includes an elastomeric biasing mechanism that extends between the plug member and the base portion and is adapted to urge the plug member into sealing contact with the seal region, and further wherein the elastomeric biasing mechanism is adapted to be stretched from a nominal length as the valve assembly is configured from the closed position to the dispensing position.

44. The system of claim 43, wherein the elastomeric biasing mechanism is positioned within the valve assembly generally upstream from the seal region such that drink fluid flowing past the plug member to the outlet flows by the elastomeric biasing mechanism.

45. The system of claim 43, wherein the elastomeric biasing mechanism is at least partially formed from an elastomeric material.

46. The system of claim 43, wherein the elastomeric biasing mechanism is at least partially formed from a deflectable material.

47. The system of claim 43, wherein the plug member includes a top surface that is adapted to sealingly engage the seal region and a sidewall that extends from the top surface generally away from the dispensing portion, and further wherein the elastomeric biasing mechanism extends between the sidewall of the plug member and the body of the drink spout system.

48. The system of claim 43, wherein the elastomeric biasing mechanism includes apertures through which drink fluid may flow.

49. The system of claim 43, wherein the fluid conduit has an outer perimeter and the seal region extends around the outer perimeter of the fluid conduit.

50. The system of claim 43, wherein the inlet is oriented generally transverse to the direction of fluid flow through the fluid conduit.

51. The system of claim 43, wherein the valve assembly includes a seal member that is formed from a resilient material and which is adapted to form a seal between the plug member and the seal region.

52. The system of claim 43, wherein the contactor is mounted on the plug member.

53. The system of claim 43, wherein the contactor includes a plurality of spaced-apart supports extending from the dispensing portion.

54. The system of claim 53, wherein the contactor couples the plug member and the dispensing portion together to move as a unit.

55. The system of claim 43, wherein the plug member and seal region are at least substantially formed from a rigid material.

56. The system of claim 43, wherein the plug member is adapted to move in a range of positions generally concurrent and countercurrent to the direction of fluid flow through the fluid conduit.

57. The system of claim 43, wherein the drink spout system further includes an air return system adapted to permit air from external the compartment to enter the compartment as drink fluid is dispensed from the outlet, wherein the air return system includes at least one air return inlet on the body through which air from external the drink container may be drawn as drink fluid is dispensed through the drink spout system, at least one air return outlet in fluid communication with the at least one air return inlet and adapted to deliver the air into the compartment as drink fluid is dispensed through the drink spout system, and at least one air passage interconnecting the at least one air return inlet and the at least one air return outlet.

58. The system of claim 57, wherein the air return system further includes a return valve assembly that is selectively configurable between an open position, in which air may pass through the at least one air passage and into the compartment, and a closed position, in which the return valve assembly obstructs the at least one air passage so that air may not pass through the at least one air passage and into the compartment, and further wherein the return valve assembly is adapted to automatically return to the closed position.

59. The system of claim 58, wherein the drink spout system further includes a flow restrictor adapted to prevent the air entering the compartment through the air return system from being drawn as air bubbles into the fluid conduit as drink fluid is dispensed from the drink container.

60. The system of claim 59, wherein the flow restrictor is adapted to prevent the air entering the compartment through the air return system from being drawn into the fluid conduit as drink fluid is dispensed from the drink container regardless of the orientation of the drink container.

61. The system of claim 58, wherein the return valve assembly and the elastomeric biasing mechanism are at least substantially formed from an elastomeric material.

62. The system of claim 61, wherein the return valve assembly and the elastomeric biasing mechanism are integrally formed.

63. The system of claim 62, wherein the return valve assembly and the elastomeric biasing mechanism are generally concentrically oriented relative to each other, with the return valve assembly extending radially outward relative to the elastomeric biasing mechanism.

64. The system of claim 57, wherein the body includes a cover adapted to prevent at least a portion of the at least one air return inlet from being obstructed when a user drinks from the drink spout system.

65. The system of claim 57, wherein the body includes means for preventing the at least one air return inlet from being obstructed when a user drinks from the drink spout system.

66. The system of claim 43, wherein the body further includes a lock mechanism that is selectively configurable between a locked position, in which the plug member is prevented from being urged from the seal region, and an unlocked position, in which the plug member may be moved away from seal region as the dispensing portion is moved generally toward the valve assembly.

67. A drink spout system, comprising:

a body having a base portion adapted to couple the drink spout system on a drink container having a compartment adapted to contain drink fluid, a dispensing portion coupled to the base portion and selectively movable relative thereto, and a seal region, wherein the dispensing portion includes an outlet through which drink fluid passes as it is dispensed from the drink spout system, and further wherein the dispensing portion defines at least a portion of a fluid conduit through which drink fluid flows though the drink spout system to the outlet;

a valve assembly adapted to selectively permit drink fluid to flow through the fluid conduit to the outlet, wherein the valve assembly includes a plug member coupled to the body by a plurality of supports that extend between the body and the plug member and are biased to urge the plug member into contact with the seal region, wherein the valve assembly is selectively configurable between a closed position, in which the plug member engages the seal region to prevent drink fluid from flowing into and through the fluid conduit to the outlet, and a dispensing position, in which the plug member is urged away from the seal region to define an inlet to the fluid conduit through which the drink fluid may flow through the valve assembly, and further wherein the supports are adapted to automatically return the plug member toward the closed position; and a contactor adapted to urge the plug member away from the seal region when the dispensing portion is moved in a direction generally toward the plug member, wherein the contactor is mounted on at least one of the dispensing portion and the plug member and is positioned generally between the plug member and the dispensing portion such that movement of the dispensing portion in a direction generally toward the plug member causes the contactor to urge the plug member toward the dispensing position.

68. The system of claim 67, wherein the contactor is mounted on the plug member and the dispensing portion so that the plug member and dispensing portion move as a unit.

69. The system of claim 67, wherein the supports are at least partially formed from an elastomeric material.

70. The system of claim 67, wherein the supports are at last partially formed from a deflectable material.

71. The system of claim 70, wherein the supports are formed from a non-elastomeric material.

72. The system of claim 67, wherein the drink spout system further includes an air return system adapted to permit air from external the compartment to enter the compartment as drink fluid is dispensed from the outlet, wherein the air return system includes at least one air return inlet on the body through which air from external the drink container may be drawn as drink fluid is dispensed through the drink spout system, at least one air return outlet in fluid communication with the at least one air return inlet and adapted to deliver the air into the compartment as drink fluid is dispensed through the drink spout system, and at least one air passage interconnecting the at least one air return inlet and the at least one air return outlet.

73. The system of claim 72, wherein the air return system further includes a return valve assembly that is selectively configurable between an open position, in which air may pass through the at least one air passage and into the compartment, and a closed position, in which the return valve assembly obstructs the at least one air passage so that air may not pass through the at least one air passage and into the compartment.

74. The system of claim 73, wherein the drink spout system further includes a flow restrictor adapted to prevent the air entering the compartment through the air return system from being drawn as air bubbles into the fluid conduit as drink fluid is dispensed from the drink container.

75. The system of claim 74, wherein the flow restrictor is adapted to prevent the air entering the compartment through the air return system from being drawn into the fluid conduit as drink fluid is dispensed from the drink container regardless of the orientation of the drink container.

76. The system of claim 73, wherein the plurality of supports and the return valve assembly are integrally formed.

77. The system of claim 73, wherein the plurality of supports and the return valve assembly are at least substantially formed from an elastomeric material.

78. The system of claim 77, wherein the elastomeric material is selected from the group consisting of silicone and thermoplastic elastomers.

79. The system of claim 67, in combination with a drink container having an internal compartment adapted to contain drink fluid and an opening over which the drink spout system is mounted.

80. The system of claim 79, wherein the drink container is an aseptic drink container and the compartment contains drink fluid.

81. The system of claim 79, wherein the drink container has a neck with an opening and a reduced cross-sectional area compared to at least a substantial portion of the drink container, wherein the neck has a diameter of less then 6 centimeters, and further wherein the base portion of the drink spout system is mounted on the neck so that drink fluid passing through the opening is received into the drink spout system.

82. The system of claim 81, wherein the neck has a diameter that is less than 4 centimeters.

83. The system of claim 82, further including an air return system adapted to deliver air from external the compartment into the compartment through a passage other than the fluid conduit.

84. The system of claim 83, wherein the air return system further includes a return valve assembly that is selectively configurable between an open position, in which air may pass through the passage and into the compartment, and a closed position, in which the return valve assembly obstructs the flow of air so that air may not pass through the passage and into the compartment.

85. The system of claim 83, wherein the drink spout system further includes a flow restrictor adapted to restrict the air entering the compartment through the air return system from being drawn into the fluid conduit as drink fluid is dispensed from the drink container.

86. The system of claim 85, wherein the flow restrictor is adapted to restrict the air entering the compartment through the air return system from being drawn into the fluid conduit as drink fluid is dispensed from the drink container regardless of the orientation of the drink container.

87. The system of claim 67, wherein the contactor extends within the fluid conduit.

88. The system of claim 67, wherein the plug member includes a top portion that is adapted to sealingly engage the seal region and a sidewall, and further wherein the supports extend between the sidewall and the body.

89. The system of claim 67, wherein the plurality of supports define apertures extending therebetween through which drink fluid may flow as the drink fluid is dispensed through the valve assembly.

* * * * *

UNITED STATES PATENT AND TRADEMARK OFFICE

CERTIFICATE OF CORRECTION

PATENT NO. : 6,629,624 B2
DATED : October 7, 2003
INVENTOR(S) : Scott H. Stillinger and Donald J. Panec It is certified that error appears in the above-identified patent and that said Letters Patent is hereby corrected as shown below:

Column 37,
Line 25, after "away from" please insert -- the --.
Line 37, after "which drink fluid flows" please delete "though" and insert -- through -- therefor.

Column 38,
Line 4, before "partially formed" please delete "last" and insert -- least -- therefor.

Signed and Sealed this

Second Day of December, 2003

JAMES E. ROGAN
*Director of the United States Patent and Trademark Office*